US007710343B2

(12) United States Patent
Chiu et al.

(10) Patent No.: US 7,710,343 B2
(45) Date of Patent: May 4, 2010

(54) COMPACT 3-PORT ORTHOGONALLY POLARIZED MIMO ANTENNAS

(75) Inventors: Chi Yuk Chiu, Hong Kong (CN); Jie Bang Yan, Hong Kong (CN); Ross David Murch, Hong Kong (CN)

(73) Assignee: Hong Kong Technologies Group Limited, Apia (WS)

( * ) Notice: Subject to any disclaimer, the term of this patent is extended or adjusted under 35 U.S.C. 154(b) by 12 days.

(21) Appl. No.: 11/873,071

(22) Filed: Oct. 16, 2007

(65) Prior Publication Data

US 2009/0096699 A1 Apr. 16, 2009

(51) Int. Cl.
*H01Q 21/26* (2006.01)
*H01Q 9/28* (2006.01)

(52) U.S. Cl. ..... 343/797; 343/795

(58) Field of Classification Search ..... 343/797, 343/795

See application file for complete search history.

(56) References Cited

U.S. PATENT DOCUMENTS

| | | | | |
|---|---|---|---|---|
| 6,317,098 | B1 * | 11/2001 | Andrews et al. | 343/797 |
| 6,480,524 | B1 | 11/2002 | Smith et al. | |
| 6,747,606 | B2 | 6/2004 | Harel et al. | |
| 7,116,281 | B2 * | 10/2006 | Rankin | 343/820 |
| 2005/0035919 | A1 * | 2/2005 | Yang et al. | 343/795 |
| 2006/0114816 | A1 | 6/2006 | Maltsev et al. | |
| 2006/0125698 | A1 * | 6/2006 | Wen et al. | 343/700 MS |
| 2006/0261905 | A1 * | 11/2006 | Ham et al. | 331/107 SL |

OTHER PUBLICATIONS

M. R. Andrews, et al. "Tripling the capacity of wireless communications using electromagnetic polarization," Nature, vol. 409, No. 6818, pp. 316-318, Jan. 2001. Last accessed Aug. 27, 2007.

N. Michishita N. Michishita, et al. "A polarization diversity antenna by printed dipole and patch with a hole," IEEE Antennas Propagat. Soc. Int. Symp., Boston, USA., Jul. 8-13, 2001, vol. 3, pp. 305-308. 0-7803-7070-8, IEEE. Last accessed Aug. 27, 2007.

D. Su, et al. "A novel broadband polarization diversity antenna using a cross-pair of folded dipoles," IEEE Antennas and Wireless Propagat. Lett., vol. 4, pp. 433-435, 2005. Digital Object Identifier 10.1109/LAWP.2005.860191.1536-1225, IEEE. Last accessed Aug. 27, 2007.

(Continued)

*Primary Examiner*—Rexford N Barnie
*Assistant Examiner*—Matthew C Tabler
(74) *Attorney, Agent, or Firm*—Turocy & Watson, LLP

(57) ABSTRACT

Generalized non-limiting embodiments include employing a dipole antenna and/or a half slot antenna. Each of the antennas constitutes three mutually perpendicular radiating elements to achieve good isolation and low antenna signal correlation between the three ports. In one generalized non-limiting embodiment the antennas are fabricated on FR-4 epoxy boards. Experimental results show that the antennas resonate a reasonable frequency and have a desired mutual coupling. In addition experimental results for the diversity performance and the MIMO channel capacity are also provided for these antennas and these results show that the herein described antennas offer good diversity gain and the channel capacity can be increased by as much as three times by using these antennas over conventional antennas.

20 Claims, 10 Drawing Sheets

3D view of 3-port tri-polarized dipole antenna.

OTHER PUBLICATIONS

Huey-Ru Chuang Huey-Ru Chuang, et al. "3-D FDTD design analysis of a 2.4GHz polarization-diversity printed dipole antenna with integrated balun and polarization-switching circuit for WLAN and wireless communication applications," IEEE Trans. on Microwave Theory and Tech., vol. 51, No. 2, pp. 374-381, Feb. 2003. Digital Object Identifier 10.1109/TMTT.2002.807838. 0018-9480, IEEE. Last accessed Aug. 27, 2007.

Liang Dong. "Simulation of MIMO channel capacity with antenna polarization diversity," IEEE Trans. on Wireless Commun., vol. 4, No. 4. pp. 1869-1873, Jul. 2005. Digital Object Identifier 10.1109/TWC.2005.850318. 1536-1276, IEEE. Last accessed Aug. 27, 2007.

D. D. Stancil, et al. "Doubling wireless channel capacity using co-polarized, co-located electric and magnetic dipoles," IEEE Electronics Lett., vol. 39, No. 14, pp. 746-747, Jul. 2002. Electronics Letters Online No. 20020442. DOI: 10.1049/e1:20020442. Last accessed Aug. 27, 2007.

R. G. Vaughan, et al. "Antenna diversity in mobile communications," IEEE Trans. Veh. Technol., vol. VT-36, pp. 147-172, Nov. 1987. IEEE Log No. 8718834. 0018-9545/87/1100-014, IEEE. Last accessed Aug. 27, 2007.

S. Blanch, et al. "Exact representation of antenna system diversity performance from input parameter description," Elect. Lett., vol. 39, No. 9, pp. 705-707, May 2003. Elecrronics Letlers Online No. 20030495. Dol: IO. 1049/e1:200304Y5. Last accessed Aug. 27, 2007.

C. Y. Chiu. "Design of a flat fading 4×4 MIMO testbed for antenna characterization using a modular approach," IEEE Wireless Commun. Netw. Conf., Hong Kong, Mar. 11-15, 2007. 1525-3511/07, IEEE. Last accessed Aug. 27, 2007.

International Search Report & Written Opinion mailed Jul. 13, 2009 for PCT Application Serial No. PCT/IB08/03850, 8 pages.

* cited by examiner

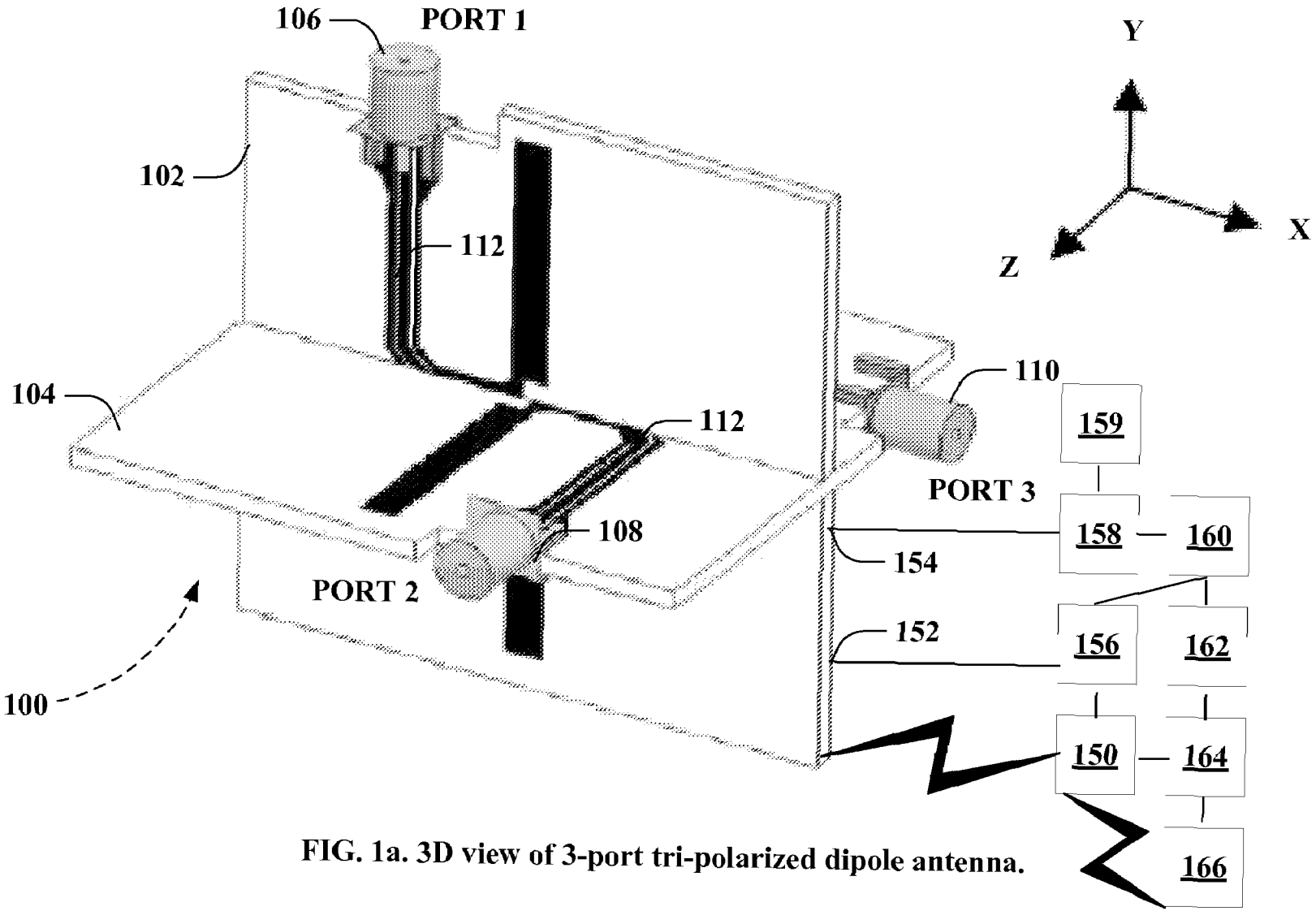
FIG. 1a. 3D view of 3-port tri-polarized dipole antenna.

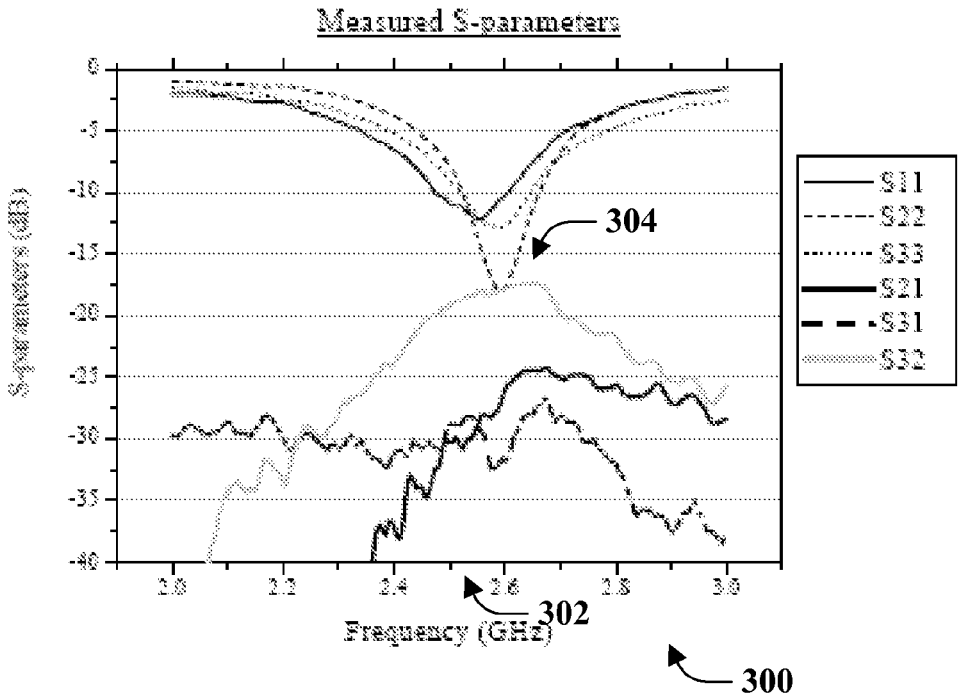
Fig. 3. Measured S-parameters of the 3-port tri-polarized dipole antenna.
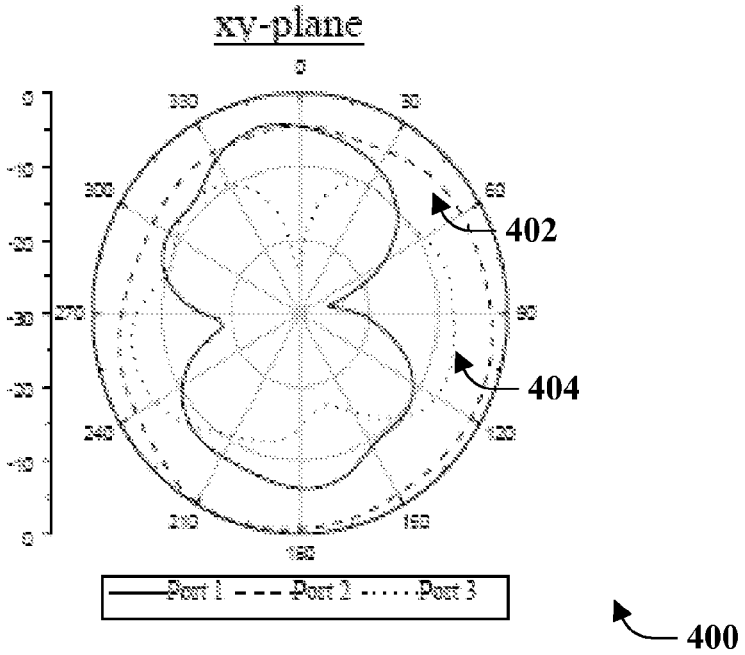
Fig. 4. Measured far-field patterns of the 3-port tri-polarized dipole antenna at 2.58 GHz.

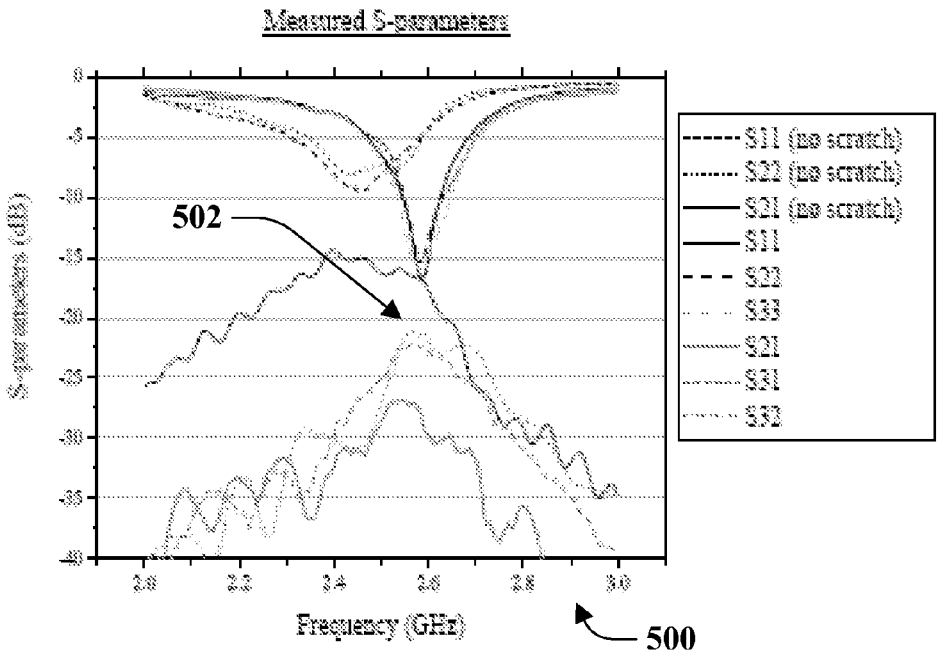
Fig. 5. Measured S-parameters of the 3-port tri-polarized half-slot antenna.
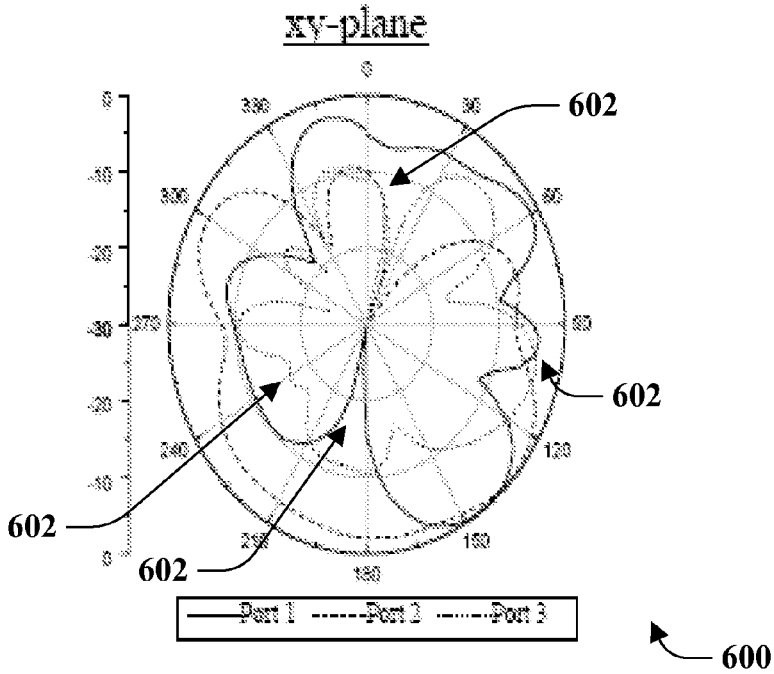
Fig. 6. Measured far-field patterns of the 3-port tri-polarized half-slot antenna at 2.58 GHz.

700

COMPACT 3-PORT ORTHOGONALLY POLARIZED MIMO ANTENNAS

TECHNICAL FIELD

The subject disclosure relates generally to multiple input multiple output (MIMO) wireless communication systems. The subject disclosure is particularly related to MIMO wireless communication systems that use polarization diversity.

BACKGROUND

Multiple-input multiple-output (MIMO) technology is a technique that exploits multiple antennas to increase channel capacity without requiring additional spectrum or transmit power. With multiple antennas at the transmitter and receiver, capacity gains can be achieved by utilizing spatial and polarization diversity. In practical applications, due to the constraint of the spacing of the antenna elements, polarization diversity is preferred since the antennas can be co-located. At least one study has concluded that, with three orthogonal components of the electric field and three of the magnetic field, it is possible to obtain 6 independent channels at a single point. However there are few published MIMO antenna designs, and even fewer exploiting tri-polarization.

A MIMO wireless communication system is one that includes typically a plurality of antennas at a transmitter and one or more antennas at a receiver. The antennas are employed in a multi-path rich environment such that due to the presence of various scattering objects (buildings, cars, hills, etc.) in the environment, each signal experiences multipath propagation. User data is transmitted from the transmit antennas using a space-time coding (STC) transmission method as is known in the art. The receive antennas capture the transmitted signals and a signal processing technique is then applied as is known in the art, to separate the transmitted signals and recover the user data.

MIMO wireless communication systems are advantageous in that they enable the capacity of the wireless link between the transmitter and receiver to be improved compared with previous systems because higher data rates can be obtained with MIMO. The multipath rich environment enables multiple orthogonal channels to be generated between the transmitter and receiver. Data for a single user can then be transmitted over the air in parallel over those channels, simultaneously and using the same bandwidth. Consequently, higher spectral efficiencies are achieved than with non-MIMO systems.

One problem with existing MIMO systems concerns the large size of the transmit and receive antenna arrays. Typically, MIMO transmit and receive antenna arrays have used spatially diverse antenna arrays. That is, the spacing between the individual antenna elements is arranged to be large enough such that decorrelated spatial fading is obtained. This is desired in order to reduce a need for the number of orthogonal channels from being reduced. That is, if the fading characteristics between antenna elements are similar (correlated) then the number of orthogonal channels that can be realized is reduced. For example, for rooftop installations, or antennas on towers, separations of up to 20 wavelengths can be required to achieve decorrelated fading due to the low angle spread of the multipath propagation.

It is desirable to both provide more axes such as exploiting tri-polarization with a three axis antenna and smaller size such as can be provided with a compact 3-port orthogonally polarized MIMO antenna.

SUMMARY

The generalized non-limiting embodiments described herein include two designs for a 3-port orthogonally polarized antenna. One generalized non-limiting embodiment includes employing a dipole antenna. Another generalized non-limiting embodiment includes employing a half slot antenna. Each of the antennas constitutes three mutually perpendicular radiating elements to achieve good isolation and low antenna signal correlation between the three ports. Experimental results show that the antennas resonate at a reasonable frequency and have a desired mutual coupling.

In one such exemplary non-limiting embodiment, a router can utilize one of the herein described antennas to implement MIMO type communications using three MIMO communication channels with one antenna, for example where a first MIMO communication channel can be utilized on a first axis, a second MIMO communication channel can be utilized on a second axis, and a third MIMO communication channel can be utilized on a third axis. In another embodiment, the router can utilize additional MIMO channels with two or more antennas, at least some of which can be a cross-polarized antenna or an orthogonal antenna such as a herein described antenna. In embodiments where multiple antennas (antennae) are utilized, two MIMO channels can be utilized on for each corresponding one of the antennas, although the scope of the claimed subject matter is not limited in this respect.

A simplified summary is provided herein to help enable a basic or general understanding of various aspects of exemplary, non-limiting embodiments that follow in the more detailed description and the accompanying drawings. This summary is not intended, however, as an extensive or exhaustive overview. The sole purpose of this summary is to present some concepts related to the various exemplary non-limiting embodiments of the innovation in a simplified form as a prelude to the more detailed description that follows.

BRIEF DESCRIPTION OF THE DRAWINGS

The temporal tri-port antennas and methods therefore in accordance with the innovation are further described with reference to the accompanying drawings in which:

FIG. 1*a* illustrates an antenna in accordance with the innovation;

FIG. 3 illustrates the measured S-parameters of the three-port tri-polarized dipole antennas of FIGS. 1*a*, 1*b*, and 1*c* in accordance with the innovation;

FIG. 4 illustrates the radiation patterns along the xy-plane of the three-port tri-polarized dipole antennas of FIGS. 1*a*, 1*b*, and 1*c* in accordance with the innovation;

FIG. 5 illustrates the measured S-parameters of the antenna of FIG. 2 in accordance with the innovation;

FIG. 6 illustrates the measured radiation patterns along the xy-plane of the antenna of FIG. 2 in accordance with the innovation;

DETAILED DESCRIPTION

Overview

As discussed in the background, the generalized non-limiting embodiments described herein include two designs for a 3-port orthogonally polarized antenna. One generalized non-limiting embodiment includes employing a dipole antenna. Another generalized non-limiting embodiment includes employing a half slot antenna. Each of the antennas constitutes three mutually perpendicular radiating elements to achieve good isolation and low antenna signal correlation between the three ports. In one generalized non-limiting embodiment the antennas are fabricated on FR-4 epoxy boards. FR-4 is an abbreviation for Flame Resistant 4, and is a type of material used for making a printed circuit board (PCB). Typically an FR-4 is a composite of a resin epoxy reinforced with a woven fiberglass mat. FR-4 is a material from the class of epoxy resin bonded glass fabric (ERBGF1). FR-4 meets the requirements of Underwriters Laboratories UL94-V0. The FR-4 used in PCBs is typically UV stabilized with a tetrafunctional resin system. It is typically a yellowish color. FR-4 manufactured strictly as an insulator (without copper cladding) is typically a difunctional resin system and a greenish color.

Experimental results show that the antennas resonate at 2.55 GHz frequency and have a mutual coupling of less than about −18 dB between elements. In addition experimental results for the diversity performance and the MIMO channel capacity are also provided for these antennas and these results show that the herein described antennas offer good diversity gain and the channel capacity can be increased by as much as three times by using these antennas over traditional antennas.

Figure 1C:
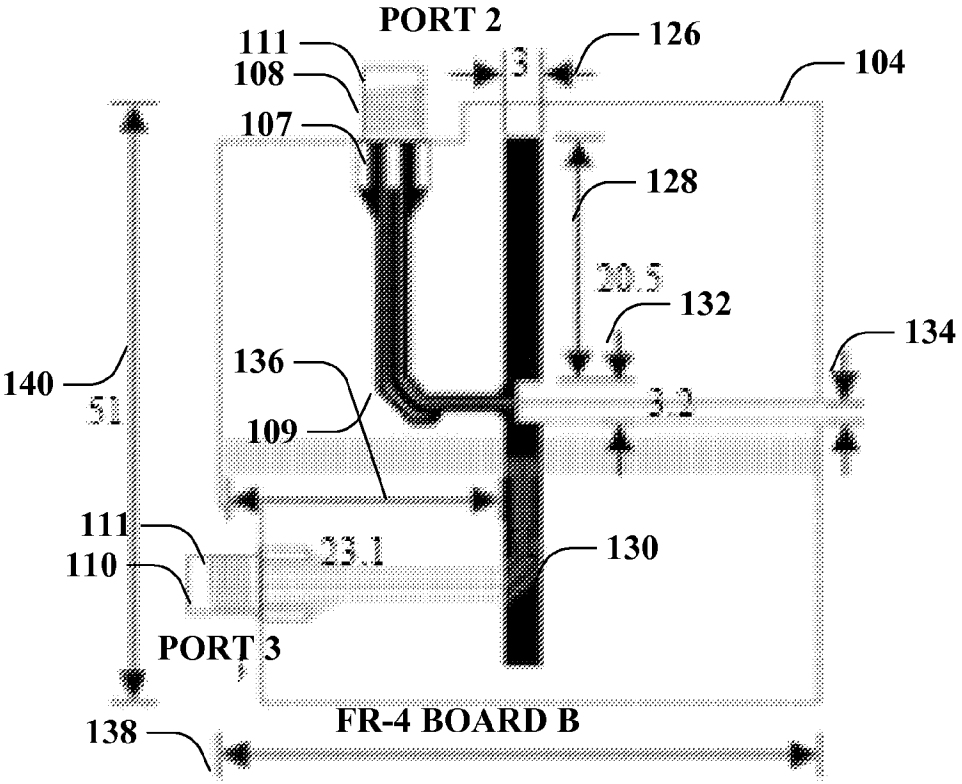
FIG. 1*c* illustrates an antenna in accordance with the innovation.
Figure 1B:
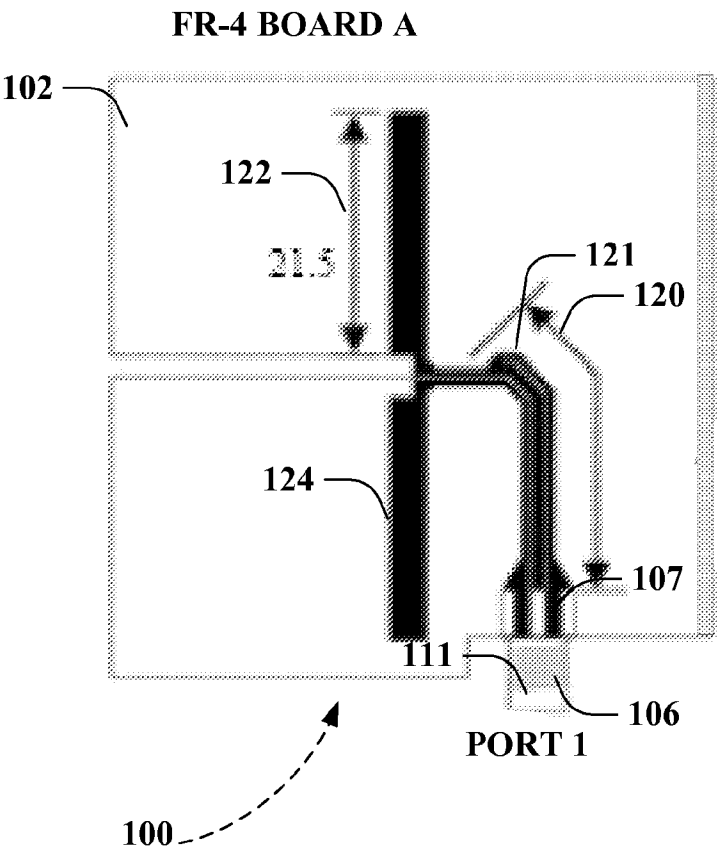
FIG. 1*b* illustrates an antenna in accordance with the innovation.

As shown in FIG. 1*a*, an antenna 100 includes a first board 102 such as a FR-4 board A (as illustrated in FIG. 1*b*) and a second board 104 such as a FR-4 board B (as illustrated in FIG. 1*c*). A port 1 (106), a port 2 (108), and a port 3 (110) are provided to communicate as described below. Antenna 100 can couple with a router 150 to provide antenna functionality to the router 150, for example where the router is a wireless router 150. Antenna 100 can include a first lead 152 and a second lead 154 to couple to a radio-frequency (RF) transceiver 156 and/or to a radio-frequency (RF) transceiver 158. RF transceiver 156 and/or RF transceiver 158 can couple to a processor 160, which in one or more embodiments can operate as a baseband processor to process baseband signals, for example. Processor 160 in one or more embodiments can operate as a broadband processor to process broadband signals. Processor 160 can couple to memory 162 that can store one or more instructions and/or programs, and/or data that can be utilized by processor 160. Processor 160 can couple to a network interface 164 to couple router 150 to a network 166.

Alternatively, router 150 wirelessly couples to network 166. In one embodiment, network 166 can include the internet or similar type of distributed network, and/or alternatively network 166 can be any type of various network such as a local area network (LAN), wide area network (WAN), metropolitan area network (MAN), and/or the like. In one or more embodiments, network 166 can comprise at least in part a wired network, and/or at least in part a wireless network. In one or more embodiments, network 166 can comprise a cellular telephone network, and/or a public switched telephone network (PSTN), and/or a plain old telephone service (POTS). However, these are merely examples of networks, and the scope of the claimed subject matter is not limited in these respects.

In one or more embodiments, router 150 can be capable of utilizing antenna 100 to communicate using one or more wireless transmission standards. For example, at least one of RF transceiver 156 and/or wireless transceiver 158 and/or a third RF transceiver 159 can be part of router 150 which can be arranged to communicate using a wireless local area network transmission standard, such as in accordance with an IEEE 802.11a standard, an IEEE 802.11b standard, an IEEE 802.11g standard, and/or an IEEE 802.11n standard. In one embodiment, router 150 can transmit and/or receive signals via antenna 100 in accordance with one such standard by transmitting and/or receiving simultaneously on all of first port 106, second axis or port 108, and third port 110 for example to provide an omnidirectional radiation pattern, or at least a nearly omnidirectional radiation pattern for signals transmitted and/or received using such a standard. In another embodiment, router 150 can transmit and/or receive signals via antenna 100 in accordance with one such standard by transmitting and/or receiving simultaneously on all of first port 106, second axis or port 108, and third port 110 for example to provide an orthogonal transmission or reception.

In another embodiment, router 150 can transmit and/or receive signals with antenna 100 by utilizing RF transceiver 156 to communicate using a first communication standard, for example IEEE Standard 802.11a, to transmit and/or receive along first axis 106, and can transmit and/or receive signals with antenna 100 by utilizing RF transceiver 156 to communicate using a second communication standard, for example IEEE Standard 802.11g, where such communication using two standards can occur simultaneously. For example where router 150 can communicate with a first remote device using IEEE Standard 802.11a and can communicate with a second remote device using IEEE Standard 802.11g, although the scope of the claimed subject matter is not limited in this respect. Additionally, this can be extended to all three ports 106, 108, and 110 simultaneously.

It should be noted that certain generalized non-limiting exemplary embodiments can be used in a variety of applications. Although the claimed subject matter is not limited in this respect, the circuits disclosed herein can be used in many apparatuses such as in the transmitters and/or receivers of a radio system. Radio systems intended to be included within the scope of the claimed subject matter can include, by way of example, but not by way of limitation, wireless personal area networks (WPAN) such as a network in compliance with the WiMedia Alliance, a wireless local area networks (WLAN) devices and/or wireless wide area network (WWAN) devices including wireless network interface devices and/or network interface cards (NICs), base stations, access points (APs), gateways, bridges, hubs, cellular radiotelephone communication systems, satellite communication systems, two-way radio communication systems, one-way pagers, two-way pagers, personal communication systems (PCS), personal computers (PCs), personal digital assistants (PDAs), and/or the like, although the scope of the claimed subject matter is not limited in this respect.

Types of wireless communication systems intended to be within the scope of the claimed subject matter can include, although are not limited to, Wireless Local Area Network (WLAN), Wireless Wide Area Network (WWAN), Code Division Multiple Access (CDMA) cellular radiotelephone communication systems, Global System for Mobile Communications (GSM) cellular radiotelephone systems, North American Digital Cellular (NADC) cellular radiotelephone systems, Time Division Multiple Access (TDMA) systems, Extended-TDMA (E-TDMA) cellular radiotelephone systems, third generation (3G) systems like Wideband CDMA (WCDMA), CDMA-2000, and/or the like, although the scope of the claimed subject matter is not limited in this respect.

In one or more embodiments, the router 150 can operate using multiple-input, multiple output (MIMO) type communication. In one particular embodiment, the router 150 can operate in accordance with an IEEE 802.11n standard. In a MIMO type embodiment, the router 150 can utilize one of antenna 100 for MIMO type and/or smart antenna type communication, for example where RF transceiver 156 and RF transceiver 158 are arranged to operate in a MIMO type mode. In one particular embodiment, router 150 can be a MIMO Wireless Router, although the scope of the claimed subject matter is not limited in this respect.

In one such exemplary generalized non-limiting embodiment, router 150 can utilize one of antenna 100 to implement MIMO type communications using three MIMO communication channels with antenna 100, for example where a first MIMO communication channel can be utilized on first axis 106, a second MIMO communication channel can be utilized on second axis 108, and a third MIMO communication channel can be utilized on third axis 108. In another embodiment, router 150 can utilize additional MIMO channels with two or more antennas, at least some of which can be a cross-polarized antenna or an orthogonal antenna such as antenna 100.

In embodiments where multiple antennas such as antenna 100 are utilized, two MIMO channels can be utilized on for each corresponding one of antenna 100, although the scope of the claimed subject matter is not limited in this respect. In an alternative embodiment, router 150 can implement a spatial division multiple access (SDMA) system, smart antenna system, and/or a multiple input, multiple output (MIMO) system, although the scope of the claimed subject matter is not limited in this respect. Router 150 can couple with network 166 so that a remote device can communicate with network 166, including devices coupled to network 166, by communicating with the router 150 via a wireless communication link and antenna 100. Network 166 can include a public network such as a telephone network and/or the internet, and/or alternatively network 112 can include a private network such as an intranet, and/or a combination of a public and/or a private network, although the scope of the claimed subject matter is not limited in this respect.

Processor 160 can operate to provide baseband and/or media access control (MAC) processing functions. Processor 160 can comprise a single processor, and/or alternatively can comprise a baseband processor and/or an applications processor, although the scope of the claimed subject matter is not limited in this respect. Processor 160 can couple to memory 162 which can comprise volatile memory such as DRAM, non-volatile memory such as flash memory, and/or alternatively can include other types of storage such as a hard disk drive, although the scope of the claimed subject matter is not limited in this respect. Some portion or all of memory 162 can be included on the same integrated circuit as processor 160, and/or alternatively some portion and/or all of memory 162 can be disposed on an integrated circuit and/or other medium, for example a hard disk drive, that is external to the integrated circuit of processor 160, although the scope of the claimed subject matter is not limited in this respect.

Communication between the router 150 to a remote device can be implemented via a wireless personal area networks (WPAN) such as in compliance with the WiMedia Alliance, a wireless local area network (WLAN), for example a network compliant with a an Institute of Electrical and Electronics Engineers (IEEE) standard such as IEEE 802.11a, IEEE 802.11b, IEEE 802.11g, IEEE 802.11n, IEEE 802.16, HiperLAN-II, HiperMAN, Ultra-Wideband (UWB), and so on, although the scope of the claimed subject matter is not limited in this respect. In another embodiment, communication between router 150 and a remote device can be at least partially implemented via a cellular communication network compliant with a Third Generation Partnership Project (3GPP or 3G) standard, a Wideband CDMA (WCDMA) standard, and/or other types of cellular networks, although the scope of the claimed subject matter is not limited in this respect.

FIG. 1*b* and FIG. 1*c* illustrate the antenna 100 with the first board 102 separated from the second board 104. The tri-polarized dipole antenna is constructed by integrating three dipole antennas which are fabricated on two 51 mm×51 mm×1.6 mm FR-4 epoxy boards (dielectric constant of approximately $\in_r$=4.5), as shown in FIGS. 1*a*, 1*b*, and 1*c*. In one exemplary generalized non-limiting embodiment, lengths 138 and 140 are both 51 mm. However, in other exemplary generalized non-limiting embodiments, the lengths 138 and 140 are less than 51 mm. A coplanar waveguide-to-coplanar strip (CPW-to-CPS) transition 120 is designed to act as an unbalance-to-balance transformer (balun) from the Sub Miniature version A (SMA) connector 111 to the arms of the dipole. In one exemplary generalized non-limiting embodiment the lengths of the dipole arm 107 and the transition 109 are approximately one quarter of the length of the guided wavelength that is 20.5 mm long at 128 and 3 mm wide.

Note that the different guided wavelengths 122 and 124 are in one exemplary embodiment 21.5 mm for port 1, while the length 136 of the guided wavelength for port 3 is 23.1 mm. Of course, one of skill in the art should realize that these lengths can be adjusted. The overall length of the dipole is 0.37λ in one exemplary generalized non-limiting embodiment. The CPW-to-CPS transition 120 is chosen to act as a balun because of its uniplanar structure. It is also bent by 90 degrees at the CPS side such that the three dipoles can be integrated together orthogonally to form a tri-polarized antenna as illustrated in FIG. 1*a*. It is worth mentioning that the bend is chamfered to avoid high current density concentrating at the bending discontinuity 121. The chamfer can be from 35 degrees to 70 degrees, but in one exemplary generalized non-limiting embodiments the chamfer is about 45 degrees.

To achieve the same resonance frequency at 2.5 GHz for the three dipoles, the lengths of dipole 2 and dipole 3 are tuned to 21.5 mm and 23.1 mm respectively in one exemplary generalized non-limiting embodiment. It should be noted that dipole 3 is offset from the intersecting point of dipole 1 and dipole 2 so that a slot can be cut at 134 for assembling antenna 100 as shown in FIG. 1*a*. Slot 134 is 3.2 mm wide in one exemplary generalized non-limiting embodiment. In other exemplary generalized non-limiting embodiments, slot 134 can be between 2 mm and 4.4 mm. Alternatively, in still other exemplary generalized non-limiting embodiments, slot 134 can be between 1.3 mm and 5.1 mm. In addition, to obtain better mutual coupling among the elements, dipole 3 is made to be the mirror image of dipole 1 and dipole 2 such that the dipoles 1, 2, and 3 are orthogonal.

Figure 2:
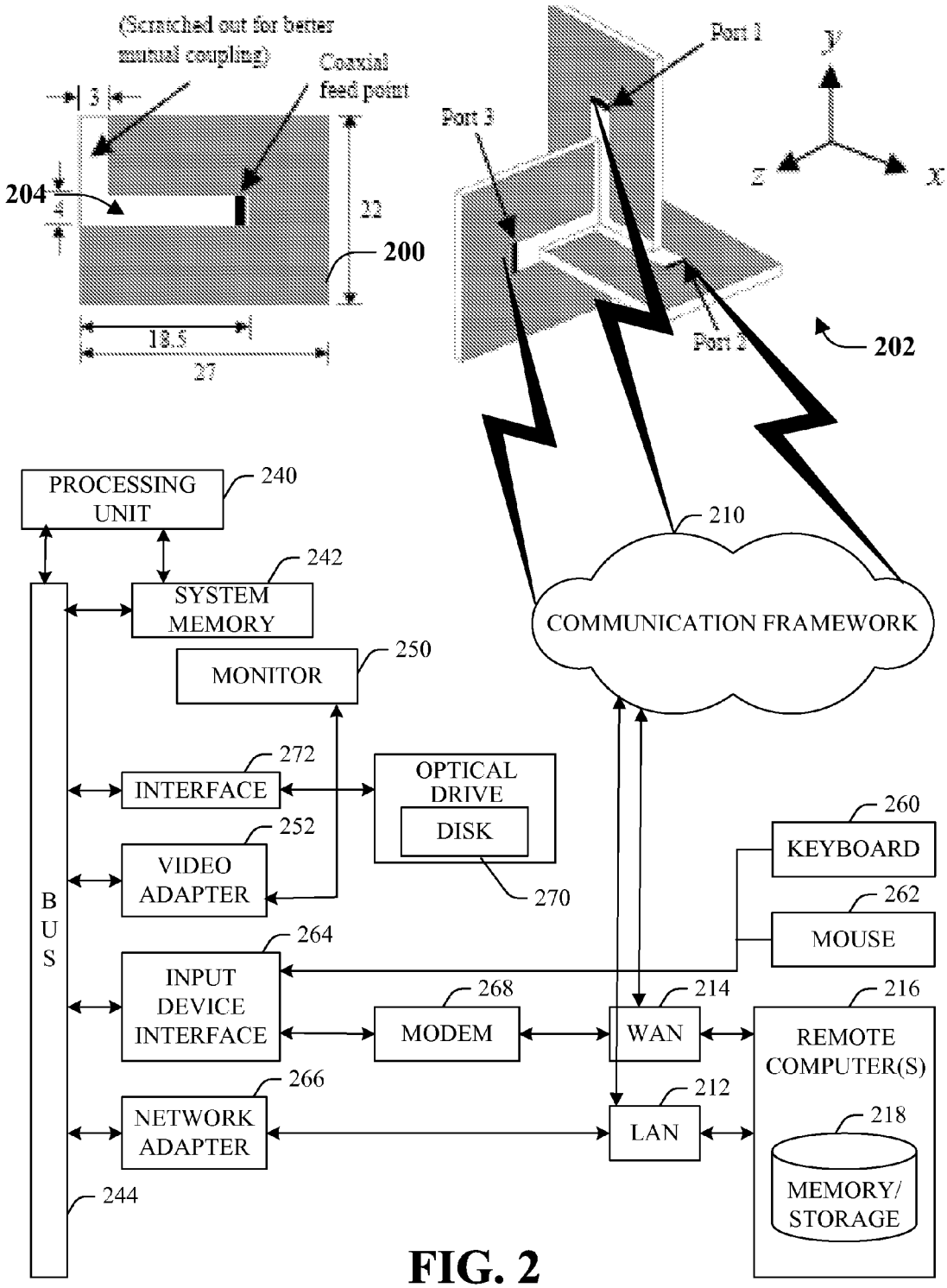
FIG. 2 illustrates a half-slot antenna design in accordance with the innovation.

FIG. 2 illustrates a half-slot antenna design with an (a) side illustrating a single board 200 and a (b) side illustrating an antenna 202 formed by three boards 200. Antenna 202 is also fabricated on a FR-4 epoxy board with overall size of about 22 mm×27 mm×about 1.6 mm in one exemplary generalized non-limiting embodiment. The length of a slot 204 is 0.148λ which is equal to 18.5 mm in one exemplary generalized non-limiting embodiment. The half-slot antenna 202 is evolved from a standard slot antenna with half-wavelength resonant length. For a standard slot antenna, its midpoint is always open after a quarter-wavelength from the feed side, no matter if the other half of the slot is present or not. Therefore a half-slot antenna can still resonate at the same frequency as a normal slot antenna, but with its length reduced by half. A tri-polarized antenna can then be formed by integrating three of these half-slot antennas orthogonally, as illustrated in part b of FIG. 2. It should be pointed out that the metal on one side of the slot is scratched out (removed) (see e.g., FIG. 2 part (a) and FIG. 5) before assembling, otherwise, the half-slot antennas would not have a sharp resonance and the mutual coupling among each other is high. Although herein dimensions are provided, there is inherent leeway in the dimensions and therefore as used herein "about" means within 20% plus or minus, "in close tolerance to" means within 10% plus or minus, and "in tight tolerance to" means within 5% plus or minus, and for every numerical limitation or description disclosed herein these variances may be applied unless otherwise explicitly noted.

As shown in FIG. 2, the antenna 200 includes a port 1, a port 2 and a port 3 that are provided to communicate as described below. Antenna 200 includes a coaxial feed point in which a coaxial or other type of cable can be attached in order to transmit or receive from or to a communication framework 210. For example, antenna 200 can couple with a LAN or WAN along with a plurality of remote computers 216 having associated memory storage 218. The exemplary environment 210 for implementing various aspects of the innovation includes a computer-processing unit 240, a system memory 242, and a system bus 244. The system bus 244 couples system components including, but not limited to, the system memory 242 to the processing unit 240. The processing unit 240 can be any of various commercially available processors. Dual microprocessors and other multi processor architectures can also be employed as the processing unit 240.

The system bus 244 can be any of several types of bus structure that can further interconnect to a memory bus (with or without a memory controller), a peripheral bus, and a local bus using any of a variety of commercially available bus architectures. The system memory 242 includes read-only memory (ROM) and random access memory (RAM). A basic input/output system (BIOS) is stored in a generalized non-volatile memory such as ROM, EPROM, EEPROM, which BIOS contains the basic routines that help to transfer information between elements within the computer 240, such as during start-up. The RAM can also include a high-speed RAM such as static RAM for caching data.

The computer processor 240 further includes an internal hard disk drive (HDD) (e.g., EIDE, SATA), which internal hard disk drive can also be configured for external use in a suitable chassis (not shown), a magnetic floppy disk drive (FDD), (e.g., to read from or write to a removable diskette) and an optical disk drive, (e.g., reading a CD-ROM disk or, to read from or write to other high capacity optical media such as the DVD). The hard disk drive, magnetic disk drive, and optical disk drive can be connected to the system bus by a hard disk drive interface, a magnetic disk drive interface, and an optical drive interface, respectively. The interface for external drive implementations includes at least one or both of Universal Serial Bus (USB) and IEEE 1394 interface technologies. Other external drive connection technologies are within contemplation of the subject innovation.

The drives and their associated computer-readable media provide non-volatile storage of data, data structures, computer-executable instructions, and so forth. For the computer 240, the drives and media accommodate the storage of any data in a suitable digital format. Although the description of computer-readable media above refers to a HDD, a removable magnetic diskette, and a removable optical media such as a CD or DVD, it should be appreciated by those skilled in the art that other types of media which are readable by a computer, such as zip drives, magnetic cassettes, flash memory cards, cartridges, and the like, can also be used in the exemplary operating environment, and further, that any such media can contain computer-executable instructions for performing the methods of the innovation.

A number of program modules can be stored in the drives and RAM, including an operating system, one or more application programs, other program modules, and program data. All or portions of the operating system, applications, modules, and/or data can also be cached in the RAM. It is appreciated that the innovation can be implemented with various commercially available operating systems or combinations of operating systems.

A user can enter commands and information into the computer 240 through one or more wired/wireless input devices, e.g., a keyboard 260 and a pointing device, such as a mouse 262. Other input devices (not shown) can include a microphone, an IR remote control, a joystick, a game pad, a stylus pen, touch screen, or the like. These and other input devices are often connected to the processing unit 240 through an input device interface 264 that is coupled to the system bus 244, but can be connected by other interfaces, such as a parallel port, an IEEE 1394 serial port, a game port, a USB port, an IR interface, etc.

A monitor 250 or other type of display device is also connected to the system bus 244 via an interface, such as a video adapter 252. In addition to the monitor 250, a computer typically includes other peripheral output devices (not shown), such as speakers, printers, etc.

The computer 240 can operate in a networked environment using logical connections via wired and/or wireless communications to one or more remote computers, such as the remote computer(s) 216. The remote computer(s) 216 can be a workstation, a server computer, a router, a personal computer, portable computer, microprocessor-based entertainment appliance, a peer device or other common network node, and typically includes many or all of the elements described relative to the computer 216, although, for purposes of brevity, only a memory/storage device 218 is illustrated. The logical connections depicted include wired/wireless connectivity to the local area network (LAN) 212 and/or larger networks, e.g., a wide area network (WAN) 214. Such LAN and WAN networking environments are commonplace in offices and companies, and facilitate enterprise-wide computer networks, such as intranets, all of which can connect to a global communications network, e.g., the Internet.

When used in a LAN networking environment, the computer 240 is connected to the local network 212 through a wired and/or wireless communication network interface or adapter 266. The adapter 266 can facilitate wired or wireless communication to the LAN 212, which can also include a wireless access point disposed thereon for communicating with the orthogonal antenna 202.

When used in a WAN networking environment, the computer 240 can include a modem 268, or is connected to a communications server on the WAN 214, or has other means for establishing communications over the WAN 214, such as by way of the Internet. The modem 268, which can be internal or external and a wired or wireless device, is connected to the system bus 244 via the serial port interface 264. In a networked environment, program modules depicted relative to the computer 240, or portions thereof, can be stored in the remote memory/storage device 218. It will be appreciated that the network connections shown are exemplary and other means of establishing a communications link between the computers can be used.

The computer 240 is operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, restroom), and telephone. This includes at least Wi-Fi and Bluetooth™ wireless technologies. Thus, the communication can be a predefined structure as with a conventional network or simply an ad hoc communication between at least two devices.

Wi-Fi, or Wireless Fidelity, allows connection to the Internet from a couch at home, a bed in a hotel room, or a conference room at work, without wires. Wi-Fi is a wireless technology similar to that used in a cell phone that enables such devices, e.g., computers, to send and receive data indoors and out; anywhere within the range of a base station. Wi-Fi networks use radio technologies called IEEE 802.11 (a, b, g, etc.) to provide secure, reliable, fast wireless connectivity. A Wi-Fi network can be used to connect computers to each other, to the Internet, and to wired networks (which use IEEE 802.3 or Ethernet). Wi-Fi networks operate in the unlicensed 2.4 and 5 GHz radio bands, at an 11 Mbps (802.11a) or 54 Mbps (802.11b) data rate, for example, or with products that contain both bands (dual band), so the networks can provide real-world performance similar to the basic 10BaseT wired Ethernet networks used in many offices.

In one or more embodiments, communication framework 210 can operate using multiple-input, multiple output (MIMO) type communication. In one particular embodiment, communication framework 210 can operate in accordance with an IEEE 802.11n standard. In a MIMO type embodiment, communication framework 210 can utilize one of antenna 202 for MIMO type and/or smart antenna type communication, for example where several RF transceivers are arranged to operate in a MIMO type mode. In one particular embodiment, communication framework 210 can utilize one of antenna 202 to implement MIMO type communications using three MIMO communication channels with antenna 202, for example where a first MIMO communication channel can be utilized on port 1, a second MIMO communication channel can be utilized on port 2, and a third MIMO communication channel can be utilized on a port 3.

In another embodiment, communication framework 210 can utilize additional MIMO channels with two or more antennas, at least some of which can be a cross-polarized antenna or an orthogonal antenna such as antenna 202. In embodiments where multiple antennas such as antenna 202 are utilized, two MIMO channels can be utilized on for each corresponding one of antenna 202, although the scope of the claimed subject matter is not limited in this respect. In an alternative embodiment, communication framework 210 can implement a spatial division multiple access (SDMA) system, smart antenna system, and/or a multiple input, multiple output (MIMO) system, although the scope of the claimed subject matter is not limited in this respect.

Processor 240 can operate to provide baseband and/or media access control (MAC) processing functions. Processor 240 can comprise a single processor, and/or alternatively can comprise a baseband processor and/or an applications processor, although the scope of the claimed subject matter is not limited in this respect. Processor 240 can couple to memory 242 which can comprise volatile memory such as DRAM, non-volatile memory such as flash memory, and/or alternatively can include other types of storage such as a hard disk drive, although the scope of the claimed subject matter is not limited in this respect. Some portion or all of memory 242 can be included on the same integrated circuit as processor 260, and/or alternatively some portion and/or all of memory 242 can be disposed on an integrated circuit and/or other medium, for example a hard disk drive, that is external to the integrated circuit of processor 260, or the computer 260 although the scope of the claimed subject matter is not limited in this respect. An optical disk drive 270 in communication to the bus 244 via an interface 272 is provided in one embodiment to provide additional storage over other storage already provided.

FIG. 3 illustrates a graph 300 of the measured S-parameters of the three-port tri-polarized dipole antennas of FIGS. 1*a*, 1*b*, and 1*c*. Scattering Parameters, or s-parameters, are the reflection and transmission coefficients between the incident and reflection waves. They describe completely the behavior of a device under linear conditions at microwave frequency range. Each parameter is typically characterized by magnitude, decibel, and phase. The expression in decibel is 20 $\log(S_{ij})$ because s-parameters are voltage ratios of the waves. For port 1 $a_1$ is the input and $b_1$ is the out put, for port 2 $a_2$ is the input and $b_2$ is the output, and for port 3 $a_3$ is the input and $b_3$ is the out put. Then for $S_{ij}=b_i/a_j$. Said differently $S_{11}$ is the input reflection coefficient of 50Ω terminated output. $S_{21}$ is the forward transmission coefficient of 50Ω terminated output. $S_{12}$ is the reverse transmission coefficient of 50Ω terminated input. $S_{22}$ is the output reflection coefficient of 50Ω terminated input. The measurement result shows that all of the three antennas resonate at approximately 2.55 GHz at 302. It can be observed that the worst-case mutual coupling is between port 2 and port 3, ($S_{32}$) which is −18 dB at 304. This mutual coupling effect is expected because dipole 2 and dipole 3 are fabricated on the same FR-4 board on the opposite side and there is a small overlapping between the dipole arm of dipole 2 and the balun of dipole 3.

FIG. 4 is a graph 400 that illustrates that the radiation patterns along the xy-plane measured at 2.58 GHz of the three-port tri-polarized dipole antennas of FIGS. 1*a*, 1*b*, and 1*c*. The far-field of each port is measured with the other two ports loaded with 50Ω. Since in many practical applications, one is only interested in effects where the distance from the antenna to the observer is very much greater than the largest dimension of the transmitting antenna, the equations describing the fields created about the antenna can be simplified by assuming a large separation and dropping all terms which provide only minor contributions to the final field. These simplified distributions have been termed the far field and usually have the property that the angular distribution of energy does not change with distance, however the energy levels still vary with distance and time. Such an angular energy distribution is usually termed an antenna pattern. From the figure, it can be seen that the field radiated by port 2 at 402 is orthogonal to that field radiated by port 3 at 404. Hence, dual polarization can be obtained on the xy-plane. Since three dipoles are located along the x, y, and z axes respectively the herein described antennas are therefore capable of achieving tri-polarization. The gain and efficiency of the port 1 are measured and are found to be 3.2 dB and 74% respectively.

The measured S-parameters of the antenna of FIG. 2 are shown in FIG. 5 in a graph 500 where in $S_{ij}$ are as defined above with reference to FIG. 3. As seen from the figure, the worst-case mutual coupling at 2.58 GHz is −21 dB at 502. It can be observed that the return losses ($S_{21}$, $S_{31}$, and $S_{32}$) of the three half-slots are similar to each other, since the antennas are symmetric about the center point. FIG. 5 illustrates the difference between no scratching off of the material and the scratching off of material on the S-parameters.

The measured radiation patterns along the xy-plane of the antenna of FIG. 2 are shown in FIG. 6 on graph 600. It is observed that the far-field patterns are irregular at irregular areas 602 and do not resemble that of a full-slot antenna. This is because there is a sharp discontinuity for the current path at the end of the half-slot. However, as the half-slot antenna has linearly polarized fields and three half-slot antennas are located along the x, y and z axes respectively, the antenna of FIG. 2 can therefore radiate and receive signals along three orthogonal planes. The gain and efficiency of the port 1 are measured and are found to be 4.8 dB and 80% respectively.

Diversity Performance

A system would have an ideal diversity performance if the signal correlation coefficients are zero and the mean received signal-to-noise ratios are equal. In case of practical system using maximum ratio combining at the receiver, a condition for good diversity action is $\rho<0.8$, where $\rho$ is the signal correlation coefficient. For practical antennas with non-ideal radiation efficiency, the upper bound of the signal correlation coefficient can be obtained the equation, $$|\rho_{ij}|_{max} = \left|\frac{-S_{ii}^{*}S_{ij} - S_{ji}^{*}S_{jj}}{\sqrt{(1-|S_{ii}|^2-|S_{ji}|^2)(1-|S_{jj}|^2-|S_{ij}|^2)\eta_i\eta_j}}\right| + \sqrt{\left(\frac{1}{\eta_i}-1\right)\left(\frac{1}{\eta_j}-1\right)}$$

where $|\rho_{ij}|_{max}$ is the upper bound of the signal correlation coefficient between antenna i and antenna j; $\eta_i$ and $\eta_j$ are the radiation efficiencies of antenna i and antenna j respectively. From the above expression, the maximum values of the signal correlation coefficients of the proposed antennas are computed using the measured data and the results are summarized in Table I below. As seen from the table, the upper bounds of the correlation coefficients of the proposed antennas do not exceed the criteria given. Hence, it can be concluded that both of the herein described antennas have excellent diversity performance.

TABLE I

Computed signal correlation coefficients of the herein described antennas.

| Antenna | | Dipole | Half-slot |
|---|---|---|---|
| i | j | $\lvert\rho_{ij}\rvert_{max}$ | $\lvert\rho_{ij}\rvert_{max}$ |
| 1 | 2 | 0.48 | 0.36 |
| 1 | 3 | 0.41 | 0.38 |
| 2 | 3 | 0.56 | 0.46 |

To determine the capacity gain of the herein described exemplary non-limiting tri-port antennas, an experimental measurement was performed of the MIMO channel capacity using a 4×4 MIMO antenna test bed. The test bed provides one with frequency flat MIMO channel estimates with an accuracy of approximately ±2% at 2.55 GHz. The flat fading MIMO capacity can then be determined from these estimates.

Figure 7:
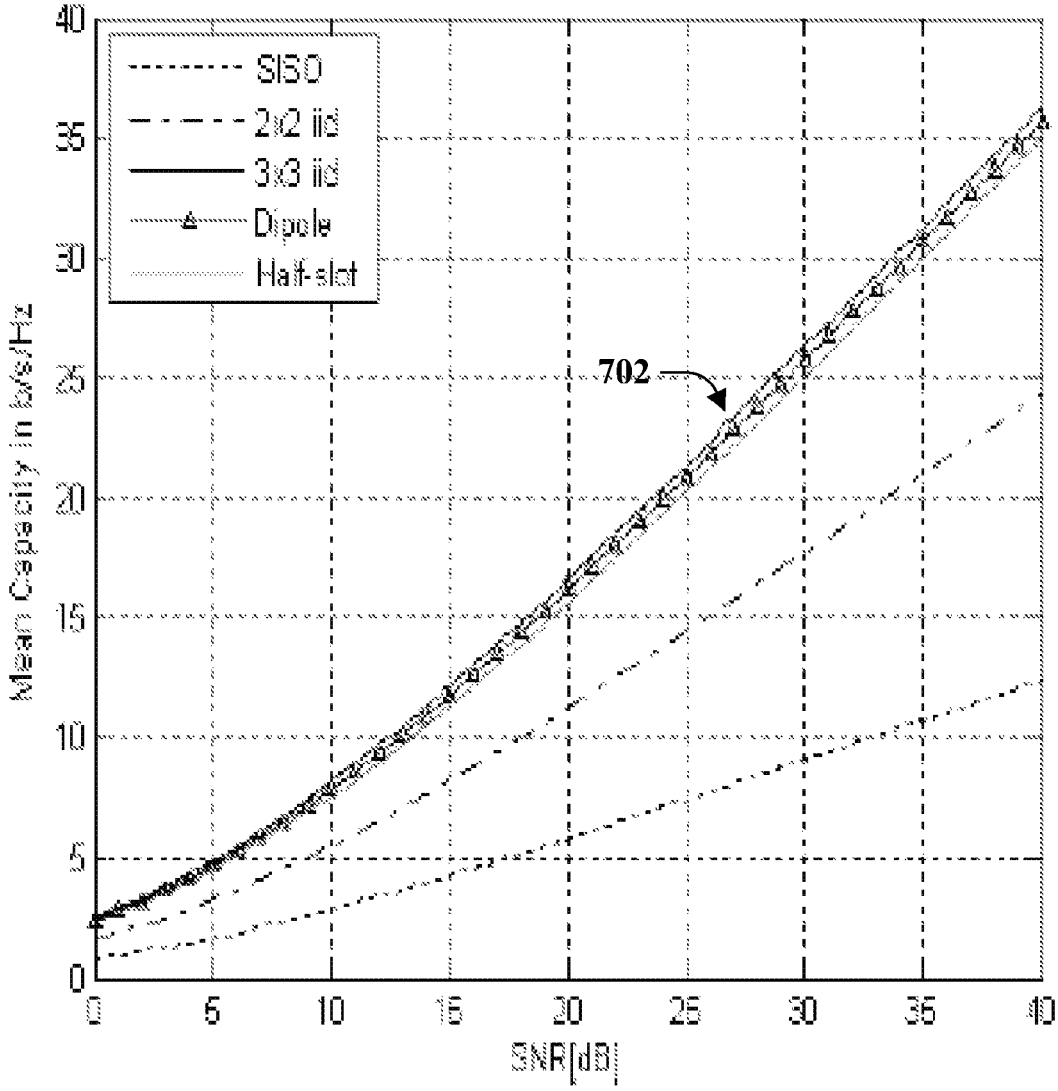
FIG. 7 illustrates capacity estimates in accordance with the innovation.

In the measurement setup, a linear arrangement of four dipoles with element separation of half-wavelength is placed at the transmitter side, while the Antenna-Under-Test (AUT) is placed at the receiver and the 3×3 MIMO channel estimates are extracted. The measurements were performed in a laboratory which resembles a rich scattering environment (the channel statistics are approximately Rayleigh distributed) with no line of sight transmission path. FIG. 7 is a graph of the capacity estimates. From the results, it can be observed that the herein described exemplary generalized non-limiting tri-port antennas provide channel capacities close to the theoretical 3×3 MIMO capacity as the three plots are all clustered together generally at 702. This demonstrates that that the herein described exemplary generalized non-limiting tri-port antennas can be used in a MIMO wireless communication system. One reason for the capacity loss is due to the mutual coupling between elements.

Herein described are designs for three-port antennas including three mutually perpendicular radiating elements using dipole and half-slot antennas. Because of the perpendicular configuration, the mutual coupling between the antenna elements in the herein described antennas is less than −18 dB. By exploiting polarization diversity, the herein described antennas can transmit information through three independent channels. Measurement results demonstrate that the herein described antennas possess good diversity gain and the MIMO channel capacity is close to that as predicted by theory.

Figure 8:
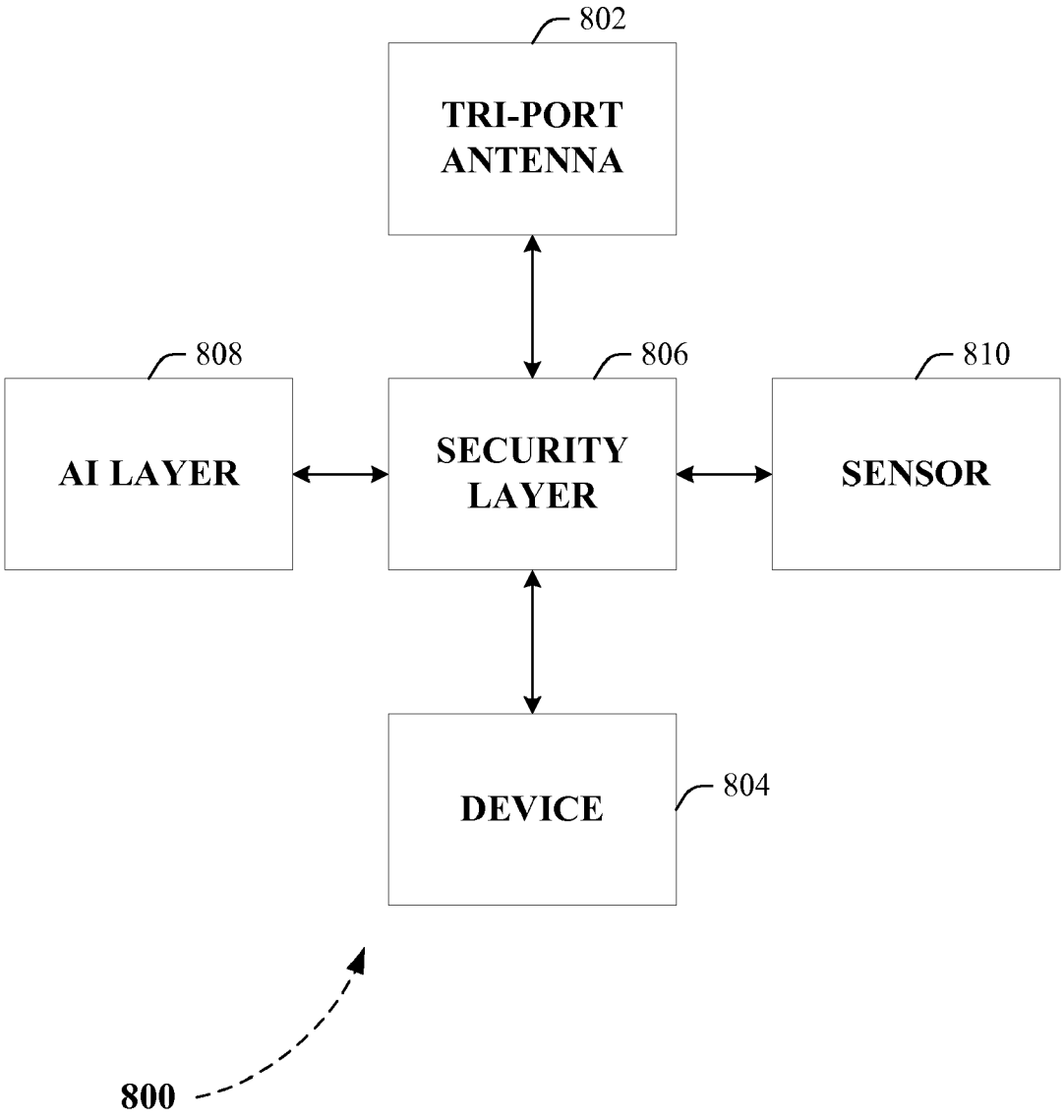
FIG. 8 illustrates a communication environment wherein a tri-port antenna is in wireless communication with a device in accordance with the innovation.

FIG. 8 illustrates a communication environment 800 wherein a tri-port antenna 802 is in wireless communication with a device 804. Device 804 can be a wireless device and antenna 802 can be in direct communication with the device 804, or the device 804 can be a wired device and the antenna 802 is in communication with the device 804 through a intermediately device (not shown), however some of the communication path involves wireless communication. The device can be any device already described herein or it can be a device not already herein described such as a user wearable device such as a wearable personal computers (or "wearables"). Wearables are devices that commonly serve as electronic companions and intelligent assistants to their users, and are typically strapped to their users' bodies or carried by their user in a holster. Like other computers, wearables can have access to a wide variety of input devices. Moreover, in addition to more conventional input devices, a wearable can have a variety of other input devices such as chording keyboards or a digitizer tablet. Similarly, a wearable computer can have access to a wide variety of sensors, such as barometric pressure sensors, global positioning system devices, or a heart rate monitor for determining the heart rate of its user. Wearables also can have access to a wide variety of generalized non-conventional output devices.

Device 804 can be virtually any electronic device where data can be stored. Examples of such electronic devices can include a computer, a cellular phone, a digital phone, a video device (e.g., video playing and/or recording device), a smart card, a personal digital assistant (PDA), a television, an electronic game (e.g., video game), a digital camera (stand alone or integrated with a cellular phone), an electronic organizer, an audio player and/or recorder, an electronic device associated with digital rights management, Personal Computer Memory Card International Association (PCMCIA) cards, trusted platform modules (TPMs), Hardware Security Modules (HSMs), set-top boxes, secure portable tokens, Universal Serial Bus (USB) tokens, key tokens, secure memory devices with computational capabilities, devices with tamper-resistant chips, and the like.

Because at least a portion of the communication between the device 804 and the tri-port antenna is wireless, a security layer 806 is provided in one exemplary generalized non-limiting embodiment. The security layer 806 can be used to cryptographically protect (e.g., encrypt) data as well as to digitally sign data, to enhance security and unwanted, unintentional, or malicious disclosure. In operation, the security component or layer 802 can communicate data to/from both the antenna 802 and the retrieval component device 804.

An encryption component can be used to cryptographically protect data during transmission as well as while stored. The encryption component employs an encryption algorithm to encode data for security purposes. The algorithm is essentially a formula that is used to turn data into a secret code. Each algorithm uses a string of bits known as a 'key' to perform the calculations. The larger the key (e.g., the more bits in the key), the greater the number of potential patterns can be created, thus making it harder to break the code and descramble the contents of the data.

Most encryption algorithms use the block cipher method, which code fixed blocks of input that are typically from 64 to 128 bits in length. A decryption component can be used to convert encrypted data back to its original form. In one aspect, a public key can be used to encrypt data upon transmission to a storage device. Upon retrieval, the data can be decrypted using a private key that corresponds to the public key used to encrypt.

A signature component can be used to digitally sign data and documents when transmitting and/or retrieving from the device 804. It is to be understood that a digital signature or certificate guarantees that a file has not been altered, similar to if it were carried in an electronically sealed envelope. The 'signature' is an encrypted digest (e.g., one-way hash function) used to confirm authenticity of data. Upon accessing the data, the recipient can decrypt the digest and also re-compute the digest from the received file or data. If the digests match, the file is proven to be intact and tamper free. In operation, digital certificates issued by a certification authority are most often used to ensure authenticity of a digital signature.

Still further, the security layer 806 can employ contextual awareness (e.g., context awareness component) to enhance security. For example, the contextual awareness component can be employed to monitor and detect criteria associated with data transmitted to and requested from the device 804. In operation, these contextual factors can be used to filter spam, control retrieval (e.g., access to highly sensitive data from a public network), or the like. It will be understood that, in aspects, the contextual awareness component can employ logic that regulates transmission and/or retrieval of data in accordance with external criteria and factors. The contextual awareness employment can be used in connection with an artificial intelligence (AI) layer 808.

The AI layer or component can be employed to facilitate inferring and/or determining when, where, how to dynamically vary the level of security. Such inference results in the construction of new events or actions from a set of observed events and/or stored event data, whether or not the events are correlated in close temporal proximity, and whether the events and data come from one or several event(s) and data source(s).

The AI component can also employ any of a variety of suitable AI-based schemes in connection with facilitating various aspects of the herein described innovation. Classification can employ a probabilistic and/or statistical-based analysis (e.g., factoring into the analysis utilities and costs) to prognose or infer an action that a user desires to be automatically performed. The AI layer can be used in conjunction with the security layer to infer changes in the data being transferred and make recommendations to the security layer as to what level of security to apply.

For example, a support vector machine (SVM) classifier can be employed. Other classification approaches include Bayesian networks, decision trees, and probabilistic classification models providing different patterns of independence can be employed. Classification as used herein also is inclusive of statistical regression that is utilized to develop models of priority.

Additionally a sensor 810 can be employed in conjunction with the security layer 806. Still further, human authentication factors can be used to enhance security employing sensor 810. For instance, biometrics (e.g., fingerprints, retinal patterns, facial recognition, DNA sequences, handwriting analysis, voice recognition) can be employed to enhance authentication to control access of the storage vault. It will be understood that embodiments can employ multiple factor tests in authenticating identity of a user.

The sensor 810 can also be used to provide the security layer 806 with generalized non-human metric data, such as electromagnetic field condition data or predicted weather data etc. For example, any conceivable condition can be sensed for and security levels can be adjusted or determined in response to the sensed condition.

One of ordinary skill in the art can appreciate that the innovation can be implemented in connection with any computer or other client or server device, which can be deployed as part of a computer network, or in a distributed computing environment, connected to any kind of data store. In this regard, the present innovation pertains to any computer system or environment having any number of memory or storage units, and any number of applications and processes occurring across any number of storage units or volumes, which can be used in connection with optimization algorithms and processes performed in accordance with the present innovation. The present innovation can apply to an environment with server computers and client computers deployed in a network environment or a distributed computing environment, having remote or local storage. The present innovation can also be applied to standalone computing devices, having programming language functionality, interpretation and execution capabilities for generating, receiving and transmitting information in connection with remote or local services and processes.

Distributed computing provides sharing of computer resources and services by exchange between computing devices and systems. These resources and services include the exchange of information, cache storage and disk storage for objects, such as files. Distributed computing takes advantage of network connectivity, allowing clients to leverage their collective power to benefit the entire enterprise. In this regard, a variety of devices can have applications, objects or resources that can implicate the optimization algorithms and processes of at least one generalized non-limiting embodiment.

Figure 9:
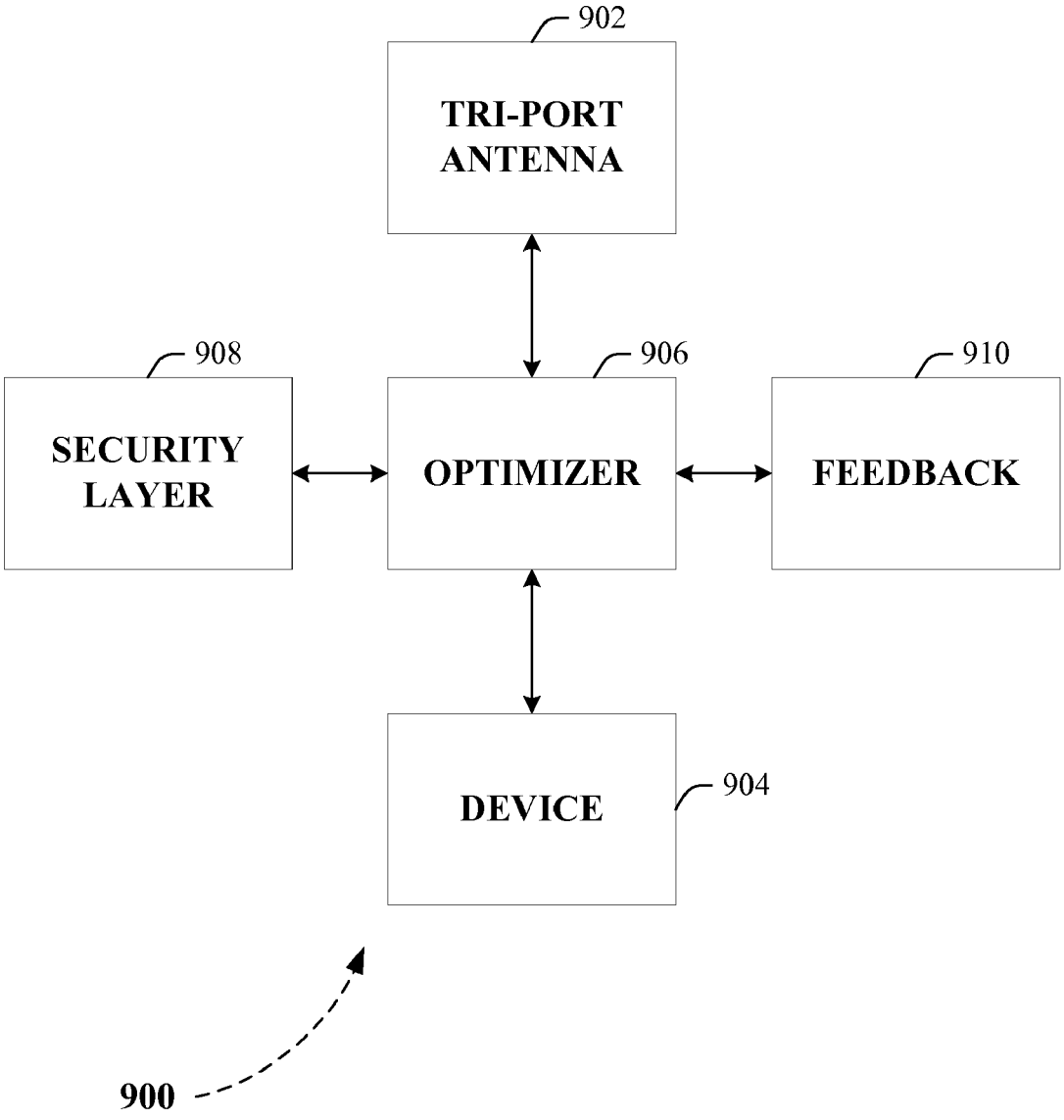
FIG. 9 illustrates a communication environment wherein a tri-port antenna is in wireless communication with a device in accordance with the innovation.

FIG. 9 illustrates a communication environment 900 wherein a tri-port antenna 902 is in wireless communication with a device 904. Device 904 can be a wireless device and antenna 902 can be in direct communication with the device

904, or the device 904 can be a wired device and the antenna 902 is in communication with the device 904 through a intermediately device (not shown), however some of the communication path involves wireless communication. An optimizer 906 is provided to optimize communication between 902 and device 904. Optimizer 906 optimizes or increases communication between 902 and device 904 by receiving security information from security layer 908. For example, when security layer 908 informs optimizer 906 that they are both in a secured environment, the optimizer 906 balances this information with other information and may instruct the security layer 908 to make all transmissions security free to achieve top speed. Additionally, a feedback layer or component 910 can provide feedback as to missed data packets or other information to provide feedback to the optimizer 906. This feedback of missed packets can be balanced against desired security level to enable less secure but higher throughput data transfer if desired.

Figure 10:
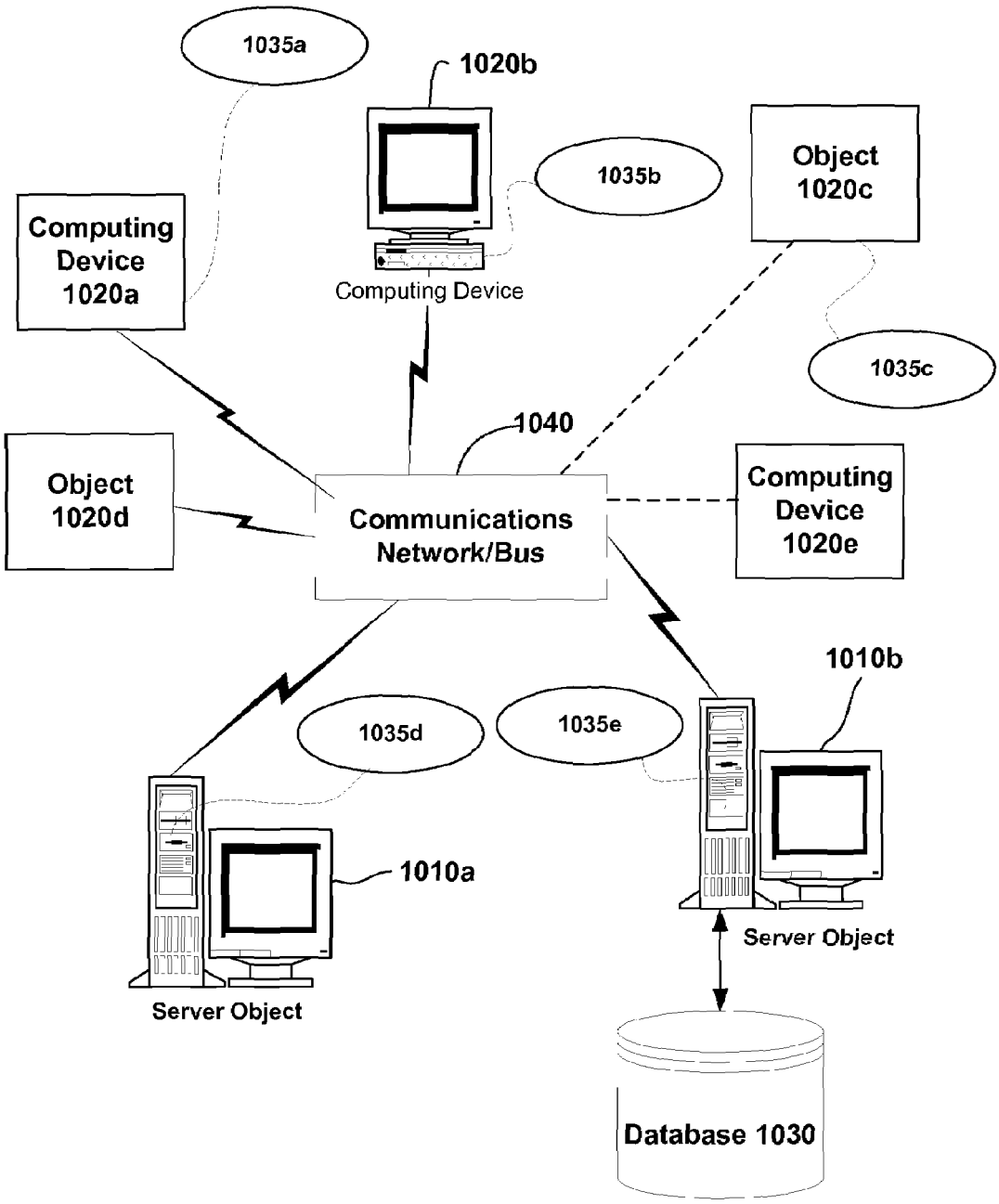
FIG. 10 is a block diagram representing an exemplary non-limiting computing system or operating environment in which the present innovation can be implemented.

FIG. 10 provides a schematic diagram of an exemplary networked or distributed computing environment. The distributed computing environment comprises computing objects 1010*a*, 1010*b*, etc. and computing objects or devices 1020*a*, 1020*b*, 1020*c*, 1020*d*, 1020*e*, etc. These objects can comprise programs, methods, data stores, programmable logic, etc. The objects can comprise portions of the same or different devices such as PDAs, audio/video devices, MP3 players, personal computers, etc. Each object can communicate with another object by way of the communications network 1040. This network can itself comprise other computing objects and computing devices that provide services to the system of FIG. 10, and can itself represent multiple interconnected networks. In accordance with an aspect of at least one generalized non-limiting embodiment, each object 1010*a*, 1010*b*, etc. or 1020*a*, 1020*b*, 1020*c*, 1020*d*, 1020*e*, etc. can contain an application that might make use of an application programming interface (API), or other object, software, firmware and/or hardware, suitable for use with the design framework in accordance with at least one generalized non-limiting embodiment.

It can also be appreciated that an object, such as 1020*c*, can be hosted on another computing device 1010*a*, 1010*b*, etc. or 1020*a*, 1020*b*, 1020*c*, 1020*d*, 1020*e*, etc. Thus, although the physical environment depicted can show the connected devices as computers, such illustration is merely exemplary and the physical environment can alternatively be depicted or described comprising various digital devices such as PDAs, televisions, MP3 players, etc., any of which can employ a variety of wired and wireless services, software objects such as interfaces, COM objects, and the like.

There are a variety of systems, components, and network configurations that support distributed computing environments. For example, computing systems can be connected together by wired or wireless systems, by local networks or widely distributed networks. Currently, many of the networks are coupled to the Internet, which provides an infrastructure for widely distributed computing and encompasses many different networks. Any of the infrastructures can be used for exemplary communications made incident to optimization algorithms and processes according to the present innovation.

In home networking environments, there are at least four disparate network transport media that can each support a unique protocol, such as Power line, data (both wireless and wired), voice (e.g., telephone) and entertainment media. Most home control devices such as light switches and appliances can use power lines for connectivity. Data Services can enter the home as broadband (e.g., either DSL or Cable modem) and are accessible within the home using either wireless (e.g., HomeRF or 802.11A/B/G) or wired (e.g., Home PNA, Cat 5, Ethernet, even power line) connectivity. Voice traffic can enter the home either as wired (e.g., Cat 3) or wireless (e.g., cell phones) and can be distributed within the home using Cat 3 wiring. Entertainment media, or other graphical data, can enter the home either through satellite or cable and is typically distributed in the home using coaxial cable. IEEE 1394 and DVI are also digital interconnects for clusters of media devices. All of these network environments and others that can emerge, or already have emerged, as protocol standards can be interconnected to form a network, such as an intranet, that can be connected to the outside world by way of a wide area network, such as the Internet. In short, a variety of disparate sources exist for the storage and transmission of data, and consequently, any of the computing devices of the present innovation can share and communicate data in any existing manner, and no one way described in the embodiments herein is intended to be limiting.

The Internet commonly refers to the collection of networks and gateways that utilize the Transmission Control Protocol/Internet Protocol (TCP/IP) suite of protocols, which are well-known in the art of computer networking. The Internet can be described as a system of geographically distributed remote computer networks interconnected by computers executing networking protocols that allow users to interact and share information over network(s). Because of such wide-spread information sharing, remote networks such as the Internet have thus far generally evolved into an open system with which developers can design software applications for performing specialized operations or services, essentially without restriction.

Thus, the network infrastructure enables a host of network topologies such as client/server, peer-to-peer, or hybrid architectures. The "client" is a member of a class or group that uses the services of another class or group to which it is not related. Thus, in computing, a client is a process, i.e., roughly a set of instructions or tasks, that requests a service provided by another program. The client process utilizes the requested service without having to "know" any working details about the other program or the service itself. In a client/server architecture, particularly a networked system, a client is usually a computer that accesses shared network resources provided by another computer, e.g., a server. In the illustration of FIG. 10, as an example, computers 1020*a*, 1020*b*, 1020*c*, 1020*d*, 1020*e*, etc. can be thought of as clients and computers 1010*a*, 1010*b*, etc. can be thought of as servers where servers 1010*a*, 1010*b*, etc. maintain the data that is then replicated to client computers 1020*a*, 1020*b*, 1020*c*, 1020*d*, 1020*e*, etc., although any computer can be considered a client, a server, or both, depending on the circumstances. Any of these computing devices can be processing data or requesting services or tasks that can implicate the optimization algorithms and processes in accordance with at least one generalized non-limiting embodiment.

A server is typically a remote computer system accessible over a remote or local network, such as the Internet or wireless network infrastructures. The client process can be active in a first computer system, and the server process can be active in a second computer system, communicating with one another over a communications medium, thus providing distributed functionality and allowing multiple clients to take advantage of the information-gathering capabilities of the server. Any software objects utilized pursuant to the optimization algorithms and processes of at least one generalized non-limiting embodiment can be distributed across multiple computing devices or objects.

Client(s) and server(s) communicate with one another utilizing the functionality provided by protocol layer(s). For example, HyperText Transfer Protocol (HTTP) is a common protocol that is used in conjunction with the World Wide Web (WWW), or "the Web." Typically, a computer network address such as an Internet Protocol (IP) address or other reference such as a Universal Resource Locator (URL) can be used to identify the server or client computers to each other. The network address can be referred to as a URL address. Communication can be provided over a communications medium, e.g., client(s) and server(s) can be coupled to one another via TCP/IP connection(s) for high-capacity communication.

Thus, FIG. 10 illustrates an exemplary networked or distributed environment, with server(s) in communication with client computer (s) via a network/bus, in which the present innovation can be employed. In more detail, a number of servers 1010*a*, 1010*b*, etc. are interconnected via a communications network/bus 1040, which can be a LAN, WAN, intranet, GSM network, the Internet, etc., with a number of client or remote computing devices 1020*a*, 1020*b*, 1020*c*, 1020*d*, 1020*e*, etc., such as a portable computer, handheld computer, thin client, networked appliance, or other device, such as a VCR, TV, oven, light, heater and the like in accordance with the present innovation. It is thus contemplated that the present innovation can apply to any computing device in connection with which it is desirable to communicate data over a network.

In a network environment in which the communications network/bus 1040 is the Internet, for example, the servers 1010*a*, 1010*b*, etc. can be Web servers with which the clients 1020*a*, 1020*b*, 1020*c*, 1020*d*, 1020*e*, etc. communicate via any of a number of known protocols such as HTTP. Servers 1010*a*, 1010*b*, etc. can also serve as clients 1020*a*, 1020*b*, 1020*c*, 1020*d*, 1020*e*, etc., as can be characteristic of a distributed computing environment.

As mentioned, communications can be wired or wireless, or a combination, where appropriate. Client devices 1020*a*, 1020*b*, 1020*c*, 1020*d*, 1020*e*, etc. can or cannot communicate via communications network/bus 14, and can have independent communications associated therewith. For example, in the case of a TV or VCR, there can or cannot be a networked aspect to the control thereof. Each client computer 1020*a*, 1020*b*, 1020*c*, 1020*d*, 1020*e*, etc. and server computer 1010*a*, 1010*b*, etc. can be equipped with various application program modules or objects 1035*a*, 1035*b*, 1035*c*, etc. and with connections or access to various types of storage elements or objects, across which files or data streams can be stored or to which portion(s) of files or data streams can be downloaded, transmitted or migrated. Any one or more of computers 1010*a*, 1010*b*, 1020*a*, 1020*b*, 1020*c*, 1020*d*, 1020*e*, etc. can be responsible for the maintenance and updating of a database 1030 or other storage element, such as a database or memory 1030 for storing data processed or saved according to at least one generalized non-limiting embodiment. Thus, the present innovation can be utilized in a computer network environment having client computers 1020*a*, 1020*b*, 1020*c*, 1020*d*, 1020*e*, etc. that can access and interact with a computer network/bus 1040 and server computers 1010*a*, 1010*b*, etc. that can interact with client computers 1020*a*, 1020*b*, 1020*c*, 1020*d*, 1020*e*, etc. and other like devices, and databases 1030.

Exemplary Computing Device

Figure 11:
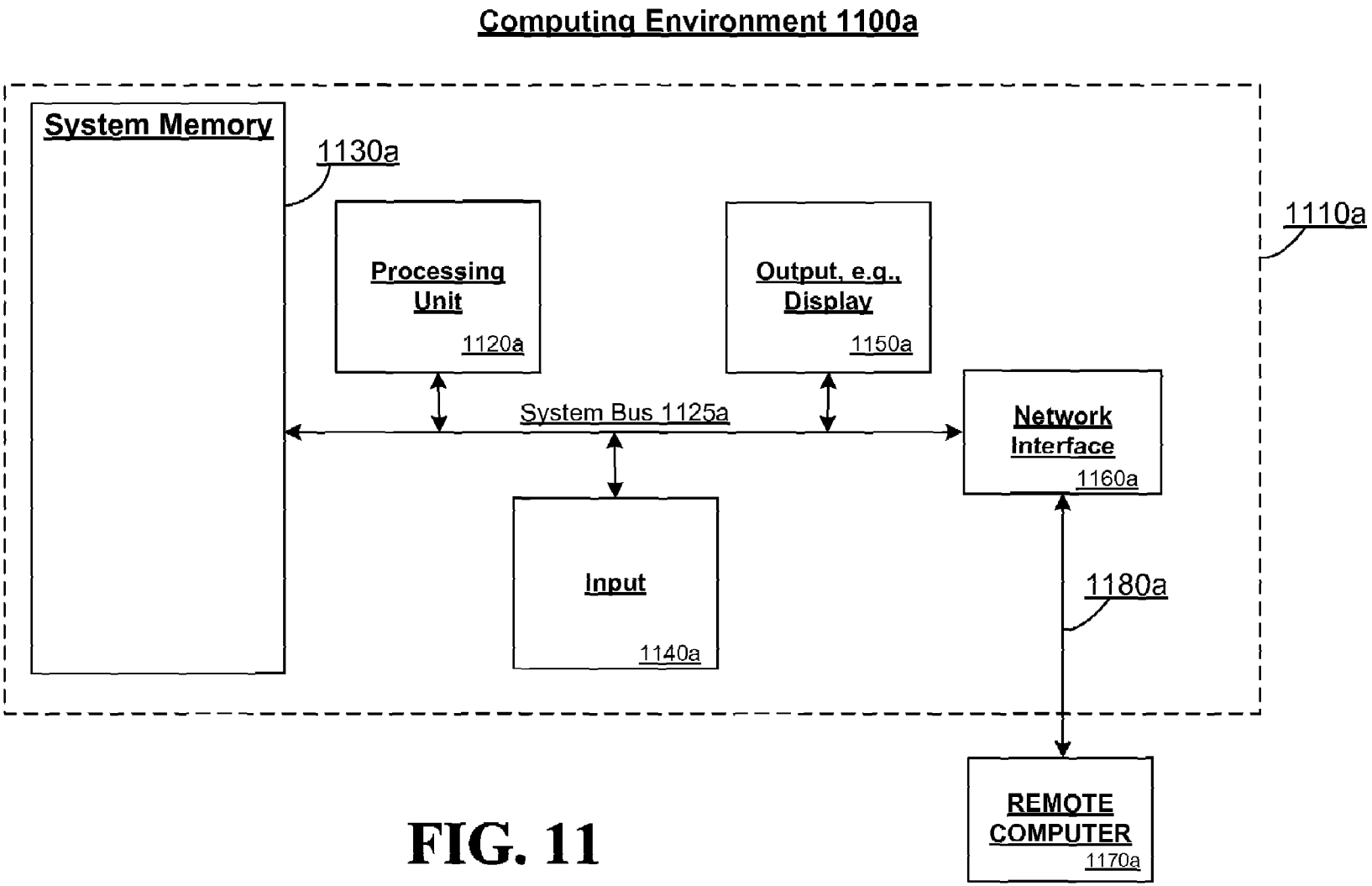
FIG. 11 illustrates an overview of a network environment suitable for service by embodiments of the innovation.

As mentioned, the innovation applies to any device wherein it can be desirable to communicate data, e.g., to a mobile device. It should be understood, therefore, that handheld, portable and other computing devices and computing objects of all kinds are contemplated for use in connection with the present innovation, i.e., anywhere that a device can communicate data or otherwise receive, process or store data. Accordingly, the below general purpose remote computer described below in FIG. 11 is but one example, and the present innovation can be implemented with any client having network/bus interoperability and interaction. Thus, the present innovation can be implemented in an environment of networked hosted services in which very little or minimal client resources are implicated, e.g., a networked environment in which the client device serves merely as an interface to the network/bus, such as an object placed in an appliance.

Although not required, at least one generalized non-limiting embodiment can partly be implemented via an operating system, for use by a developer of services for a device or object, and/or included within application software that operates in connection with the component(s) of at least one generalized non-limiting embodiment. Software can be described in the general context of computer executable instructions, such as program modules, being executed by one or more computers, such as client workstations, servers, or other devices. Those skilled in the art will appreciate that the innovation can be practiced with other computer system configurations and protocols.

FIG. 11 thus illustrates an example of a suitable computing system environment 1100*a* in which the innovation can be implemented, although as made clear above, the computing system environment 1100*a* is only one example of a suitable computing environment for a media device and is not intended to suggest any limitation as to the scope of use or functionality of the innovation. Neither should the computing environment 1100*a* be interpreted as having any dependency or requirement relating to any one or combination of components illustrated in the exemplary operating environment 1100*a*.

With reference to FIG. 11, an exemplary remote device for implementing at least one generalized non-limiting embodiment includes a general purpose computing device in the form of a computer 1110*a*. Components of computer 1110*a* can include, but are not limited to, a processing unit 1120*a*, a system memory 1130*a*, and a system bus 1125*a* that couples various system components including the system memory to the processing unit 1120*a*. The system bus 1125*a* can be any of several types of bus structures including a memory bus or memory controller, a peripheral bus, and a local bus using any of a variety of bus architectures.

Computer 1110*a* typically includes a variety of computer readable media. Computer readable media can be any available media that can be accessed by computer 1110*a*. By way of example, and not limitation, computer readable media can comprise computer storage media and communication media. Computer storage media includes volatile and non-volatile, removable and non-removable media implemented in any method or technology for storage of information such as computer readable instructions, data structures, program modules, or other data. Computer storage media includes, but is not limited to, RAM, ROM, EEPROM, flash memory or other memory technology, CDROM, digital versatile disks (DVD) or other optical disk storage, magnetic cassettes, magnetic tape, magnetic disk storage or other magnetic storage devices, or any other medium which can be used to store the desired information and which can be accessed by computer 1110*a*. Communication media typically embodies computer readable instructions, data structures, program modules or other data in a modulated data signal such as a carrier wave or other transport mechanism and includes any information delivery media.

The system memory 1130*a* can include computer storage media in the form of volatile and/or non-volatile memory such as read only memory (ROM) and/or random access memory (RAM). A basic input/output system (BIOS), containing the basic routines that help to transfer information between elements within computer 1110*a*, such as during start-up, can be stored in memory 1130*a*. Memory 1130*a* typically also contains data and/or program modules that are immediately accessible to and/or presently being operated on by processing unit 1120*a*. By way of example, and not limitation, memory 1130*a* can also include an operating system, application programs, other program modules, and program data.

The computer 1110*a* can also include other removable/non-removable, volatile/non-volatile computer storage media. For example, computer 1110*a* could include a hard disk drive that reads from or writes to non-removable, non-volatile magnetic media, a magnetic disk drive that reads from or writes to a removable, non-volatile magnetic disk, and/or an optical disk drive that reads from or writes to a removable, non-volatile optical disk, such as a CD-ROM or other optical media. Other removable/non-removable, volatile/non-volatile computer storage media that can be used in the exemplary operating environment include, but are not limited to, magnetic tape cassettes, flash memory cards, digital versatile disks, digital video tape, solid state RAM, solid state ROM and the like. A hard disk drive is typically connected to the system bus 1125*a* through a non-removable memory interface such as an interface, and a magnetic disk drive or optical disk drive is typically connected to the system bus 1125*a* by a removable memory interface, such as an interface.

A user can enter commands and information into the computer 1110*a* through input devices such as a keyboard and pointing device, commonly referred to as a mouse, trackball or touch pad. Other input devices can include a microphone, joystick, game pad, satellite dish, scanner, or the like. These and other input devices are often connected to the processing unit 1120*a* through user input 1140*a* and associated interface (s) that are coupled to the system bus 1125*a*, but can be connected by other interface and bus structures, such as a parallel port, game port or a universal serial bus (USB). A graphics subsystem can also be connected to the system bus 1125*a*. A monitor or other type of display device is also connected to the system bus 1125*a* via an interface, such as output interface 1150*a*, which can in turn communicate with video memory. In addition to a monitor, computers can also include other peripheral output devices such as speakers and a printer, which can be connected through output interface 1150*a*.

The computer 1110*a* can operate in a networked or distributed environment using logical connections to one or more other remote computers, such as remote computer 1170*a*, which can in turn have media capabilities different from device 1110*a*. The remote computer 1170*a* can be a personal computer, a server, a router, a network PC, a peer device or other common network node, or any other remote media consumption or transmission device, and can include any or all of the elements described above relative to the computer 1110*a*. The logical connections depicted in FIG. 11 include a network 1180*a*, such local area network (LAN) or a wide area network (WAN), but can also include other networks/buses. Such networking environments are commonplace in homes, offices, enterprise-wide computer networks, intranets and the Internet.

When used in a LAN networking environment, the computer 1110*a* is connected to the LAN 1180*a* through a network interface or adapter. When used in a WAN networking environment, the computer 1110*a* typically includes a communications component, such as a modem, or other means for establishing communications over the WAN, such as the Internet. A communications component, such as a modem, which can be internal or external, can be connected to the system bus 1125*a* via the user input interface of input 1140*a*, or other appropriate mechanism. In a networked environment, program modules depicted relative to the computer 1110*a*, or portions thereof, can be stored in a remote memory storage device. It will be appreciated that the network connections shown and described are exemplary and other means of establishing a communications link between the computers can be used.

While the present innovation has been described in connection with the preferred embodiments of the various Figures, it is to be understood that other similar embodiments can be used or modifications and additions can be made to the described embodiment for performing the same function of the present innovation without deviating therefrom. For example, one skilled in the art will recognize that the present innovation as described in the present application can apply to any environment, whether wired or wireless, and can be applied to any number of such devices connected via a communications network and interacting across the network. Therefore, the present innovation should not be limited to any single embodiment, but rather should be construed in breadth and scope in accordance with the appended claims.

The word "exemplary" is used herein to mean serving as an example, instance, or illustration. For the avoidance of doubt, the subject matter disclosed herein is not limited by such examples. In addition, any aspect or design described herein as "exemplary" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, for the avoidance of doubt, such terms are intended to be inclusive in a manner similar to the term "comprising" as an open transition word without precluding any additional or other elements.

Various implementations of the innovation described herein can have aspects that are wholly in hardware, partly in hardware and partly in software, as well as in software. As used herein, the terms "component," "system" and the like are likewise intended to refer to a computer-related entity, either hardware, a combination of hardware and software, software, or software in execution. For example, a component can be, but is not limited to being, a process running on a processor, a processor, an object, an executable, a thread of execution, a program, and/or a computer. By way of illustration, both an application running on computer and the computer can be a component. One or more components can reside within a process and/or thread of execution and a component can be localized on one computer and/or distributed between two or more computers.

Thus, the methods and apparatus of the present innovation, or certain aspects or portions thereof, can take the form of program code (i.e., instructions) embodied in tangible media, such as floppy diskettes, CD-ROMs, hard drives, or any other machine-readable storage medium, wherein, when the program code is loaded into and executed by a machine, such as a computer, the machine becomes an apparatus for practicing the innovation. In the case of program code execution on programmable computers, the computing device generally includes a processor, a storage medium readable by the processor (including volatile and non-volatile memory and/or storage elements), at least one input device, and at least one output device.

Furthermore, the disclosed subject matter can be implemented as a system, method, apparatus, or article of manufacture using standard programming and/or engineering techniques to produce software, firmware, hardware, or any combination thereof to control a computer or processor based device to implement aspects detailed herein. The terms "article of manufacture", "computer program product" or similar terms, where used herein, are intended to encompass a computer program accessible from any computer-readable device, carrier, or media. For example, computer readable media can include but are not limited to magnetic storage devices (e.g., hard disk, floppy disk, magnetic strips . . . ), optical disks (e.g., compact disk (CD), digital versatile disk (DVD) . . . ), smart cards, and flash memory devices (e.g., card, stick). Additionally, it is known that a carrier wave can be employed to carry computer-readable electronic data such as those used in transmitting and receiving electronic mail or in accessing a network such as the Internet or a local area network (LAN).

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components, e.g., according to a hierarchical arrangement. Additionally, it should be noted that one or more components can be combined into a single component providing aggregate functionality or divided into several separate sub-components, and any one or more middle layers, such as a management layer, can be provided to communicatively couple to such sub-components in order to provide integrated functionality. Any components described herein can also interact with one or more other components not specifically described herein but generally known by those of skill in the art.

In view of the exemplary systems described supra, methodologies that can be implemented in accordance with the disclosed subject matter will be better appreciated with reference to the various flow diagrams. While for purposes of simplicity of explanation, the methodologies are shown and described as a series of blocks, it is to be understood and appreciated that the claimed subject matter is not limited by the order of the blocks, as some blocks can occur in different orders and/or concurrently with other blocks from what is depicted and described herein. Where non-sequential, or branched, flow is illustrated via flowchart, it can be appreciated that various other branches, flow paths, and orders of the blocks, can be implemented which achieve the same or a similar result. Moreover, not all illustrated blocks can be required to implement the methodologies described hereinafter.

Furthermore, as will be appreciated various portions of the disclosed systems above and methods below can include or consist of artificial intelligence or knowledge or rule based components, sub-components, processes, means, methodologies, or mechanisms (e.g., support vector machines, neural networks, expert systems, Bayesian belief networks, fuzzy logic, data fusion engines, classifiers . . . ). Such components, inter alia, can automate certain mechanisms or processes performed thereby to make portions of the systems and methods more adaptive as well as efficient and intelligent.

While the present innovation has been described in connection with the preferred embodiments of the various figures, it is to be understood that other similar embodiments can be used or modifications and additions can be made to the described embodiment for performing the same function of the present innovation without deviating therefrom.

While exemplary embodiments refer to utilizing the present innovation in the context of particular programming language constructs, specifications or standards, the innovation is not so limited, but rather can be implemented in any language to perform the optimization algorithms and processes. Still further, the present innovation can be implemented in or across a plurality of processing chips or devices, and storage can similarly be effected across a plurality of devices. Therefore, the present innovation should not be limited to any single embodiment, but rather should be construed in breadth and scope in accordance with the appended claims.

What is claimed is:

1. A method comprising:

at least one of sending or receiving radio frequency data on at least three orthogonal channels simultaneously, wherein the at least one of sending or receiving employs a dipole tri-port antenna or a half-slot tri-port antenna, wherein the dipole tri-port antenna comprises a first board with a single dipole antenna and a second board with two dipole antennae positioned such that coupling of the first board with the second board arranges the three antennae orthogonal to each other, the half-slot tri-port antenna comprises three half slot antenna boards coupled to each other such that each half slot antenna board is orthogonal to an other two half slot antenna boards of the three half slot antenna boards.

2. The method of claim 1, wherein each channel is simultaneously communicating from a wireless device to a distinct remote wireless device, wherein each of the three orthogonal channels employs a communication standard that is distinct from communications standards employed by an other two channels of the three orthogonal channels.

3. The method of claim 1, wherein the channels are at about 2.5 GHz.

4. The method of claim 1, wherein the channels are at about 2.55 GHz.

5. The method of claim 1, wherein the first and second boards include three coplaner waveguide-to-coplaner strip transitions (CPW-to-CPS), one CPW-to-CPS for each dipole antenna as a balun, wherein each CPW-to-CPS is bent ninety degrees at a CPS side to allow the orthogonal alignment of the dipole antennae.

6. The method of claim 5, wherein the bend of the CPW-to-CPS is chamfered.

7. The antenna of claim 1, wherein each half slot antenna board has metal on one side of the slot removed where the half slot antenna board couples with another half slot antenna board.

8. An antenna comprising:

a first port;

a second port orthogonal to the first port; and a third port orthogonal to the first port and the second port, wherein:

the first, second, and third ports are dipole ports, wherein the first port is mounted on a first board, the second and third ports are mounted on a second board, the first and second boards couple to each other aligning the three ports orthogonal to each other; or the first port is a first half slot antenna board, second port is a second half slot antenna board, and third port is a third half slot antenna board, the first, second, and third half slot antenna boards couple via slots aligning the first, second, and third ports orthogonal to each other.

9. The antenna of claim 8, wherein the first dipole port is about 21.5 mm.

10. The antenna of claim 9, wherein the second dipole port is about 20.5 mm.

11. The antenna of claim 10, wherein the third dipole port is about 23.5 mm.

12. The antenna of claim 11, wherein the third dipole port is offset from an intersection of the first and second ports.

13. The antenna of claim 8, wherein the first, second, and third ports operate about at 2.55 GHz.

14. The antenna of claim 8, wherein the first, second, and third half slot antenna boards are fabricated to be substantially identical and from epoxy boards.

15. The antenna of claim 14, wherein the first, second, and third half slot antenna boards have a length that is half of a length of a standard slot antenna for a given frequency.

16. The antenna of claim 8, wherein the first and second boards include three coplaner waveguide-to-coplaner strip transitions (CPW-to-CPS), one CPW-to-CPS for each dipole antenna as a balun, wherein each CPW-to-CPS is bent ninety degrees at a CPS side to allow the orthogonal alignment of the dipole antennae.

17. The antenna of claim 16, wherein the bend of the CPW-to-CPS is chamfered.

18. The antenna of claim 8, wherein each half slot antenna board has metal on one side of the slot removed where the half slot antenna board couples with another half slot antenna board.

19. An antenna comprising:

means for sending radio frequency signals; and means for receiving radio frequency signals; wherein the means for sending and the means for receiving operate simultaneously on at least three orthogonal channels wherein at least one of the means for sending or the means for receiving employs a dipole tri-port antenna or a half-slot tri-port antenna, wherein the dipole tri-port antenna comprises a first board with a single dipole antenna and a second board with two dipole antennae positioned such that coupling of the first board with the second board arranges the three antennae orthogonal to each other, the half-slot tri-port antenna comprises three half slot antenna boards coupled to each other such that each half slot antenna board is orthogonal to an other two half slot antenna boards of the three half slot antenna boards.

20. The antenna of claim 19, wherein the first and second boards include three coplaner waveguide-to-coplaner strip transitions (CPW-to-CPS), one CPW-to-CPS for each dipole antenna as a balun, wherein each CPW-to-CPS is bent ninety degrees at a CPS side to allow the orthogonal alignment of the dipole antennae.

* * * * *